US010967636B2

(12) United States Patent
Nakayama

(10) Patent No.: US 10,967,636 B2
(45) Date of Patent: Apr. 6, 2021

(54) HEAD CHIP, LIQUID JET HEAD, AND LIQUID JET RECORDING DEVICE

(71) Applicant: SII Printek Inc., Chiba (JP)

(72) Inventor: Hitoshi Nakayama, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/698,139

(22) Filed: Nov. 27, 2019

(65) Prior Publication Data

US 2020/0180311 A1 Jun. 11, 2020

(30) Foreign Application Priority Data

Dec. 6, 2018 (JP) ..... JP2018-229310

(51) Int. Cl.
*B41J 2/14* (2006.01)
*B41J 2/16* (2006.01)
(Continued)

(52) U.S. Cl.
CPC ..... *B41J 2/1433* (2013.01); *B41J 2/14201* (2013.01); *B41J 2/164* (2013.01);
(Continued)

(58) Field of Classification Search
CPC .. B41J 2/14201; B41J 2/14209; B41J 2/1433; B41J 2/1606; B41J 2/1609; B41J 2/1623; B41J 2/1631; B41J 2/1632; B41J 2/1635; B41J 2/164; B41J 2/1642; B41J 2/175; B41J 2/18; B41J 2002/14306;
(Continued)

(56) References Cited

U.S. PATENT DOCUMENTS 8,998,381 B2 * 4/2015 Domae ..... B41J 2/14209 347/47
2009/0315957 A1 * 12/2009 Koseki ..... B41J 2/1609 347/68

(Continued)

FOREIGN PATENT DOCUMENTS

JP 2003-266691 A 9/2003
JP 2016-055544 A 4/2016

OTHER PUBLICATIONS

Extended European Search Report in Europe Application No. 19212474.1, dated Apr. 9, 2020, 9 pages.

*Primary Examiner* — Anh T Vo
(74) *Attorney, Agent, or Firm* — Brinks Gilson & Lione

(57) ABSTRACT

A head chip capable of suppressing the degradation of the reliability, and a liquid jet head and a liquid jet recording device using the head chip are provided. The head chip includes an actuator plate having a plurality of ejection channels respectively communicated with nozzle holes and electrodes disposed on inner walls of the respective ejection channels, a bonded plate to be bonded to the actuator plate, and having a liquid contact surface which liquid entered the ejection channels has contact with, an adhesive layer disposed between the bonded plate and the actuator plate, and adapted to bond the bonded plate and the actuator plate to each other, and a protective film adapted to cover continuously from inner walls of the respective ejection channels to at least a part of the liquid contact surface via an end surface of the adhesive layer exposed on the ejection channel side.

11 Claims, 19 Drawing Sheets

(51) Int. Cl.
*B41J 2/175* (2006.01)
*B41J 2/18* (2006.01)

(52) U.S. Cl.
CPC ..... *B41J 2/1606* (2013.01); *B41J 2/1623* (2013.01); *B41J 2/175* (2013.01); *B41J 2/18* (2013.01); *B41J 2002/14306* (2013.01); *B41J 2002/14491* (2013.01); *B41J 2202/12* (2013.01); *B41J 2202/13* (2013.01); *B41J 2202/19* (2013.01); *B41J 2202/20* (2013.01)

(58) Field of Classification Search
CPC .... B41J 2002/14362; B41J 2002/14491; B41J 2202/12; B41J 2202/13; B41J 2202/19; B41J 2202/20
See application file for complete search history.

(56) References Cited

U.S. PATENT DOCUMENTS

| | | | |
|---|---|---|---|
| 2012/0098897 | A1 | 4/2012 | Suzuki |
| 2014/0267497 | A1 | 9/2014 | Takagi et al. |
| 2017/0072692 | A1 | 3/2017 | Chen et al. |

* cited by examiner

HEAD CHIP, LIQUID JET HEAD, AND LIQUID JET RECORDING DEVICE

RELATED APPLICATIONS

This application claims priority to Japanese Patent Application No. 2018-229310 filed on Dec. 6, 2018, the entire content of which is incorporated herein by reference.

BACKGROUND OF THE INVENTION

1. Field of the Invention

The present disclosure relates to a head chip, and a liquid jet head and a liquid jet recording device using the head chip.

2. Description of the Related Art

As a recording device for recording an image on a recording target medium, there has been known a liquid jet recording device equipped with a liquid jet head, and the liquid jet head includes a head chip for jetting a liquid. In the liquid jet recording device, the liquid is jetted from the head chip to the recording target medium, and thus, the image is recorded on the recording target medium.

The head chip includes an actuator plate to electrically be driven for jetting the liquid. The actuator plate is provided with a plurality of ejection channels (see, e.g., JP-A-2016-55544).

The ejection channels are supplied with a liquid. The liquid supplied to the ejection channels is jetted via nozzle holes.

In such a head chip, there is a possibility that the liquid supplied to the ejection channels affects members in the vicinity of the ejection channels to degrade the reliability.

Therefore, it is desirable to provide a head chip capable of suppressing the degradation of the reliability, a liquid jet head and a liquid jet recording device using the head chip.

SUMMARY OF THE INVENTION

The head chip according to an embodiment of the present disclosure includes an actuator plate having a plurality of ejection channels respectively communicated with nozzle holes and electrodes disposed on inner walls of the respective ejection channels, a bonded plate to be bonded to the actuator plate, and having a liquid contact surface which liquid entered the ejection channels has contact with, an adhesive layer disposed between the bonded plate and the actuator plate, and adapted to bond the bonded plate and the actuator plate to each other, and a protective film adapted to cover continuously from inner walls of the respective ejection channels to at least a part of the liquid contact surface via an end surface of the adhesive layer exposed on the ejection channel side.

The liquid jet head according to an embodiment of the present disclosure includes a head chip adapted to jet a liquid, and a supply section adapted to supply the liquid to the head chip, wherein the head chip has substantially the same configuration as that of the head chip according to the embodiment of the present disclosure described above.

The liquid jet recording device according to an embodiment of the present disclosure includes a liquid jet head adapted to jet a liquid to a recording target medium, and a containing section adapted to contain the liquid, wherein the liquid jet head has substantially the same configuration as that of the liquid jet head according to the embodiment of the present disclosure described above.

According to the head chip, the liquid jet head, and the liquid jet recording device related to the embodiment of the present disclosure, it becomes possible to reduce the influence on the members adjacent to the ejection channels caused by the liquid supplied to the ejection channels to suppress the degradation of the reliability.

BRIEF DESCRIPTION OF THE DRAWINGS

FIG. 9 is a process chart showing an example of a method of manufacturing the liquid jet head shown in FIG. 2 and so on.

FIG. 19 is a process chart showing an example of a method of manufacturing the liquid jet head shown in FIG. 12 and so on.

DETAILED DESCRIPTION OF THE PREFERRED EMBODIMENTS

An embodiment of the present disclosure will hereinafter be described in detail with reference to the drawings. It should be noted that the order of the descriptions is as follows:

1. First Embodiment (an example of a side-shoot type liquid jet head performing ink circulation)
2. Modified Example (an example having an intermediate plate between an actuator plate and a nozzle plate)
3. Second Embodiment (an example of an edge-shoot type liquid jet head performing ink circulation)
4. Other Modified Examples

1. Liquid Jet Recording Device (Liquid Jet Head)

A liquid jet recording device according to an embodiment of the present disclosure will be described.

It should be noted that the liquid jet head of the embodiment of the present disclosure is a part of the liquid jet recording device described here, and therefore, the liquid jet head will also be described below in conjunction with the liquid jet recording device.

<1-1. Respective Configurations of Liquid Jet Recording Device and Liquid Jet Head>

Firstly, the respective configurations of the liquid jet recording device and the liquid jet head will be described.

Figure 1:
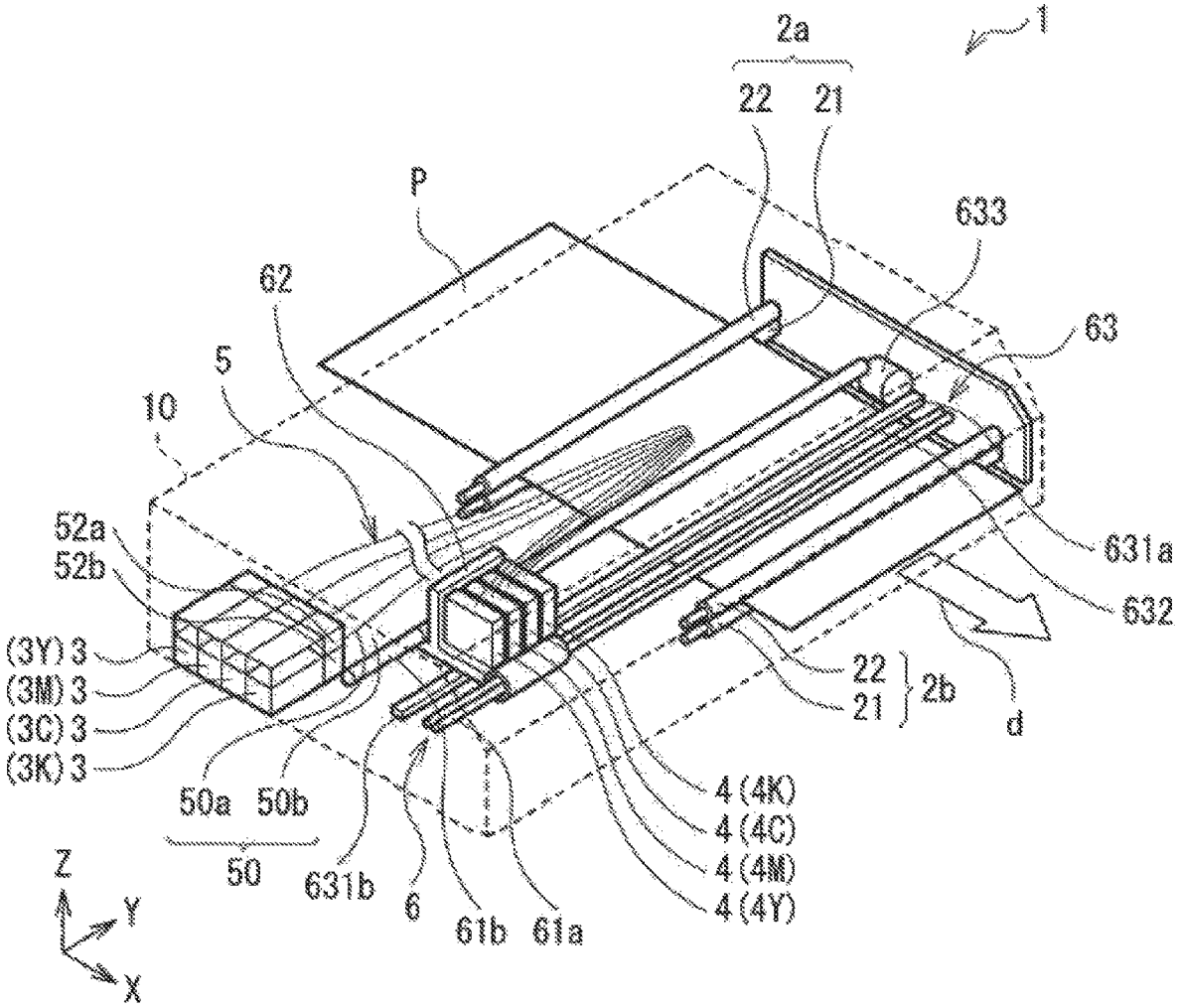
FIG. 1 is a perspective view showing a configuration of a liquid jet recording device (a liquid jet head) according to a first embodiment of the present disclosure.
Figure 2:
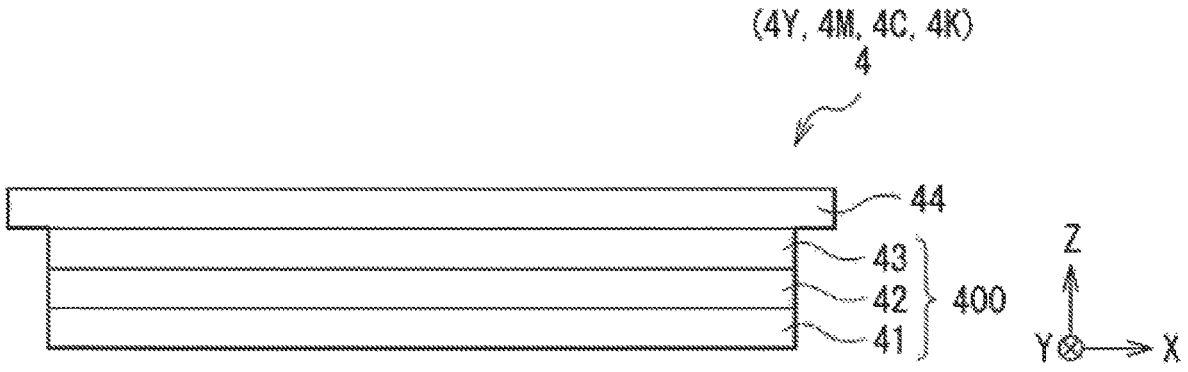
FIG. 2 is a plan view schematically showing the configuration of the liquid jet head shown in FIG. 1.
Figure 3:
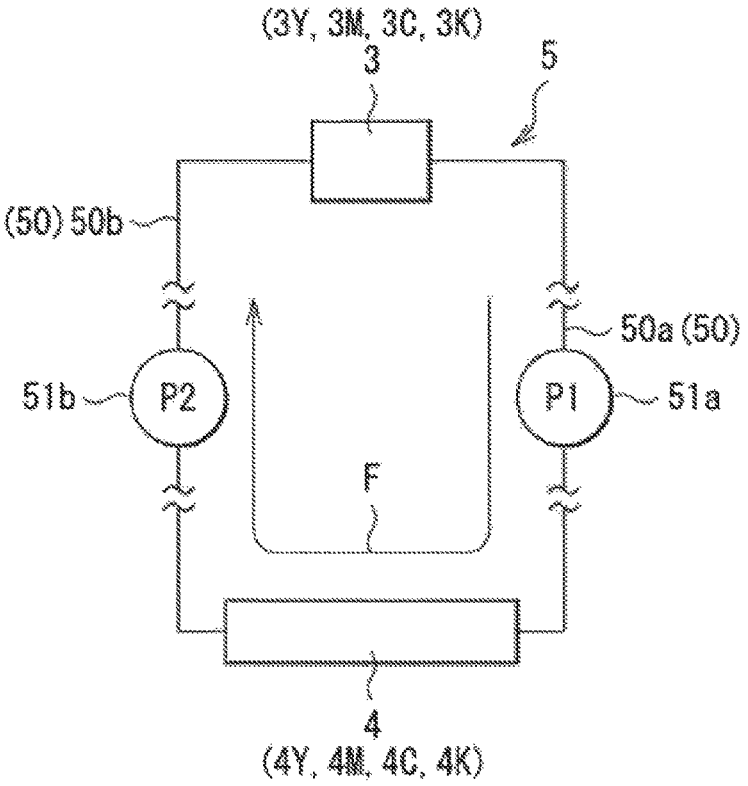
FIG. 3 is a diagram schematically showing a configuration of the circulation mechanism shown in FIG. 1.

FIG. 1 shows a perspective configuration of a printer 1 as a specific example of the liquid jet recording device. FIG. 2 schematically shows a planar configuration of an inkjet head 4 as a specific example of the liquid jet head shown in FIG. 1. FIG. 3 schematically shows a configuration of the circulation mechanism 5 shown in FIG. 1. It should be noted that in FIG. 1, the inside of a housing 10 is shown by representing an outer edge (contour) of the housing 10 using dotted lines.

This printer 1 is an inkjet type printer for mainly recording (printing) an image and the like on recording paper P as a recording target medium using ink 9 as a liquid for recording described later, and is a so-called inkjet printer.

In particular, the printer 1 described here is an inkjet printer of an ink circulation type using the ink 9 circulating in, for example, the circulation mechanism 5.

Specifically, as shown in, for example, FIG. 1 through FIG. 3, the printer 1 is provided with a pair of carrying mechanisms 2*a*, 2*b*, ink tanks 3, inkjet heads 4, the circulation mechanism 5, and a scanning mechanism 6 disposed inside the housing 10.

It should be noted that in FIG. 1 through FIG. 3 and the drawings described later, the scale size of each of the constituents is arbitrarily changed in order to convert the sizes of a series of constituents related to the printer 1 into recognizable sizes.

[Carrying Mechanisms]

The pair of carrying mechanisms 2*a*, 2*b* are each a mechanism for mainly carrying the recording paper P having loaded into the printer 1 in a carrying direction D (an X-axis direction).

The carrying mechanisms 2*a*, 2*b* each include a grit roller 21 and a pinch roller 22 as shown in, for example, FIG. 1. The grit rollers 21 and the pinch rollers 22 each extend in, for example, a direction (a Y-axis direction) crossing the carrying direction D, and are each rotatable around the rotational axis extending in that direction. Further, the carrying mechanisms 2*a*, 2*b* are each connected to a drive mechanism such as a motor not shown, and each rotate using the power of the drive mechanism.

Here, the planar shape of the recording paper P is, for example, a rectangular shape defined by a pair of long sides opposed to each other, and a pair of short sides opposed to each other. Due to this configuration, the carrying direction D is, for example, a direction (the X-axis direction) along the longitudinal direction of the recording paper P, and at the same time, the direction crossing the carrying direction D is, for example, a direction (the Y-axis direction) along the short-side direction of the recording paper P.

[Ink Tanks]

The ink tanks 3 are each a liquid storage section for mainly storing the ink 9. The ink tanks 3 each correspond to a specific example of a "containing section" in the present disclosure.

The number of the ink tanks 3 is not particularly limited, and can therefore be just one, or two or more. Here, the printer 1 is provided with the four ink tanks 3 (3Y, 3M, 3C, and 3K) for containing the ink 9 different in color from each other as shown in FIG. 1, for example. The ink tanks 3Y, 3M, 3C, and 3K are arranged in this order in, for example, the carrying direction D (the X-axis direction) from the upstream side toward the downstream side.

The ink tank 3Y stores, for example, the yellow (Y) ink 9. The ink tank 3M stores, for example, the magenta (M) ink 9. The ink tank 3C stores, for example, the cyan (C) ink 9. The ink tank 3K contains, for example, the black (K) ink 9.

The ink tanks 3Y, 3M, 3C, and 3K have substantially the same configurations except, for example, the fact that the types (colors) of the ink 9 are different from each other. Hereinafter, the ink tanks 3Y, 3M, 3C, and 3B are collectively referred to as the "ink tanks 3" if necessary.

[Inkjet Heads]

The inkjet heads 4 are each a device (head) for jetting the ink 9 to the recording paper P in order to mainly record an image and the like on the recording paper P. In this inkjet head 4, in particular, the ink 9 having a droplet form is jetted to the recording paper P.

The inkjet head 4 described here is, for example, the inkjet head 4 of a so-called side-shoot type, and jets the ink 9 from a roughly central area in an extending direction (the Y direction in FIG. 4 through FIG. 6) of each of channels C (see FIG. 4 through FIG. 6) described later. Specifically, in the inkjet head 4 of the side-shoot type, as described later, the channels C provided to an actuator plate 42 extend in the Y-axis direction, and the ink 9 is jetted from each of nozzle holes H provided to a nozzle plate 41 in a Z-axis direction crossing the Y-axis direction.

Further, the inkjet head 4 is, for example, a so-called circulation type inkjet head 4, and uses the ink 9 circulated between the ink tank 3 and the inkjet head 4 using the circulation mechanism 5 described above.

Specifically, as shown in FIG. 2, the inkjet head 4 includes a head chip 400 and a flow channel plate 44. The flow channel plate 44 is, for example, a plate-like flow channel member. The head chip 400 and the flow channel plate 44 each extend in, for example, a predetermined direction (the X-axis direction). The head chip 400 extends along one of the surfaces of the flow channel plate 44, and is fixed to the one of the surfaces of the flow channel plate 44 at the same time.

The head chip 400 includes, for example, the nozzle plate 41, the actuator plate 42, and a cover plate 43. The nozzle plate 41, the actuator plate 42, and the cover plate 43 are stacked on one another in this order, the nozzle plate 41 from the far side from the flow channel plate 44. Here, the head chip 400 corresponds to a specific example of a "head chip" in the present disclosure, and the flow channel plate 44 corresponds to a specific example of a "supply mechanism" in the present disclosure.

The number of the inkjet heads 4 is not particularly limited, and can therefore be just one, or two or more. Here, the printer 1 is provided with the four inkjet heads 4 (4Y, 4M, 4C, and 4K) for jetting the ink 9 different in color from each other in accordance with the four ink tanks 3 (3Y, 3M, 3C, and 3K) described above as shown in FIG. 1, for example. The inkjet heads 4Y, 4M, 4C, and 4K are arranged in this order in, for example, a direction (the Y-axis direction) crossing the carrying direction D.

The inkjet head 4Y jets, for example, the yellow ink 9. The inkjet head 4M jets, for example, the magenta ink 9. The inkjet head 4C jets, for example, the cyan ink 9. The inkjet head 4K jets, for example, the black ink 9.

The inkjet heads 4Y, 4M, 4C, and 4K have substantially the same configurations except, for example, the fact that the types (colors) of the ink 9 are different from each other. Hereinafter, the inkjet heads 4Y, 4M, 4C, and 4K are collectively referred to as the "inkjet heads 4" if necessary.

It should be noted that the detailed configuration of the head chip 400 (the nozzle plate 41, the actuator plate 42, and the cover plate 43) will be described later (see FIG. 4 through FIG. 6).

[Circulation Mechanism]

The circulation mechanism 5 is a mechanism for mainly circulating the ink 9 between the ink tanks 3 and the inkjet heads 4.

The circulation mechanism 5 includes circulation channels 50 of the ink 9, pressure pumps 51*a* and suction pumps 51*b* as shown in FIG. 3, for example.

The circulation channels 50 each include, for example, a first flow channel 50*a* through which the ink 9 flows from the ink tank 3 toward the inkjet head 4, and a second flow channel 50*b* through which the ink 9 flows from the inkjet head 4 toward the ink tank 3.

In each of the first flow channel 50*a* and the second flow channel 50*b*, for example, the ink 9 flows inside a tube, and the tube is, for example, a flexible tube having flexibility.

The pressure pump 51*a* is disposed in, for example, the first flow channel 50*a*. The pressure pump 51*a* pressurizes the inside of the first flow channel 50*a* to thereby supply the inkjet head 4 with the ink 9.

The suction pump 51*b* is disposed in, for example, the second flow channel 50*b*. The suction pump 51*b* reduces the pressure in the inside of the second flow channel 50*b* to thereby suction the ink 9 from the inkjet head 4.

Thus, in the circulation mechanism 5, for example, the ink 9 flows toward a circulation direction F Specifically, the ink 9 having been supplied from the ink tank 3 flows through, for example, the first flow channel 50*a*, the inkjet head 4, and the second flow channel 50*b* in this order to thereby return to the ink tank 3.

[Scanning Mechanism]

The scanning mechanism 6 is a mechanism for mainly making the inkjet head 4 perform a scanning operation in a direction (the Y-axis direction) crossing the carrying direction D.

The scanning mechanism 6 includes a pair of guide rails 61*a*, 61*b*, a carriage 62, and a drive mechanism 63 as shown in FIG. 1, for example.

The guide rails 61*a*, 61*b* each extend in, for example, a direction (the Y-axis direction) crossing the carrying direction D. The carriage 62 is, for example, supported by the guide rails 61*a*, 61*b*, and capable of moving in a direction (the Y-axis direction) crossing the carrying direction D along the guide rails 61*a*, 61*b*. The drive mechanism 63 includes, for example, a pair of pulleys 631*a*, 631*b*, a belt 632 having an endless shape, and a drive motor 633.

The pair of pulleys 631*a*, 631*b* are disposed between, for example, the guide rails 61*a*, 61*b*. The pulleys 631*a*, 631*b* are disposed at, for example, positions corresponding to areas adjacent to both ends of the guide rails 61*a*, 61*b*, respectively, so as to extend in the Y-axis direction. The belt 632 is wound between, for example, the pulleys 631*a*, 631*b*. The belt 632 is connected to, for example, the carriage 62, and on the carriage 62, there is mounted, for example, the inkjet heads 4.

By using the carrying mechanisms 2*a*, 2*b* and the scanning mechanism 6 as a moving mechanism, the recording paper P and the inkjet heads 4 can move relatively to each other.

<1-2. Specific Configuration of inkjet Head 4>

Then, the detailed configuration of the inkjet head 4 (the nozzle plate 41, the actuator plate 42, the cover plate 43, and the flow channel plate 44) will be described.

Figure 4:
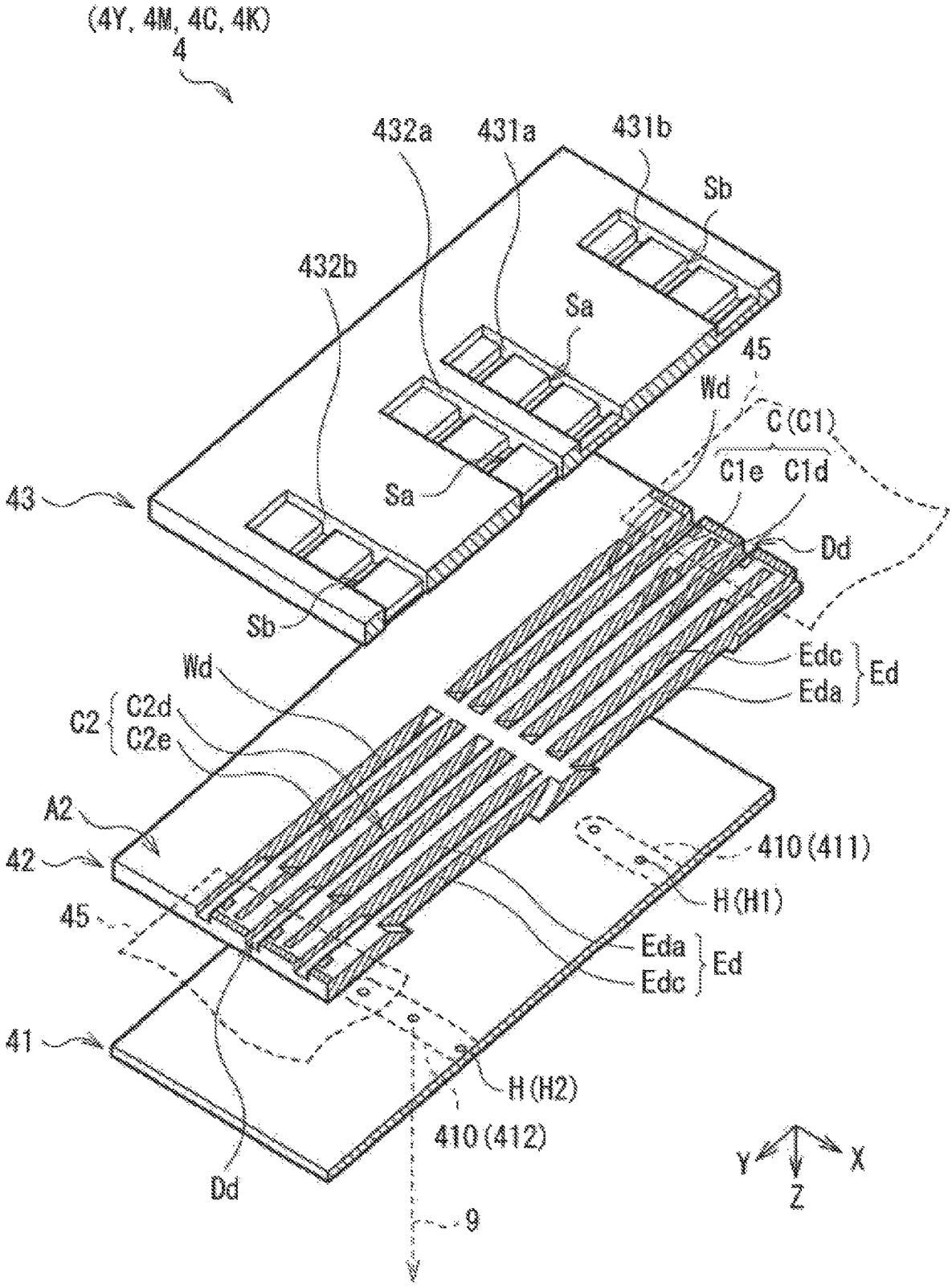
FIG. 4 is a perspective view showing respective configurations of the nozzle plate, the actuator plate, and the cover plate shown in FIG. 2.

FIG. 4 shows respective perspective configurations of the nozzle plate 41, the actuator plate 42, and the cover plate 43 shown in FIG. 2. It should be noted that in FIG. 4, there is shown a state in which the nozzle plate 41, the actuator plate 42, and the cover plate 43 are separated from each other.

Figure 5:
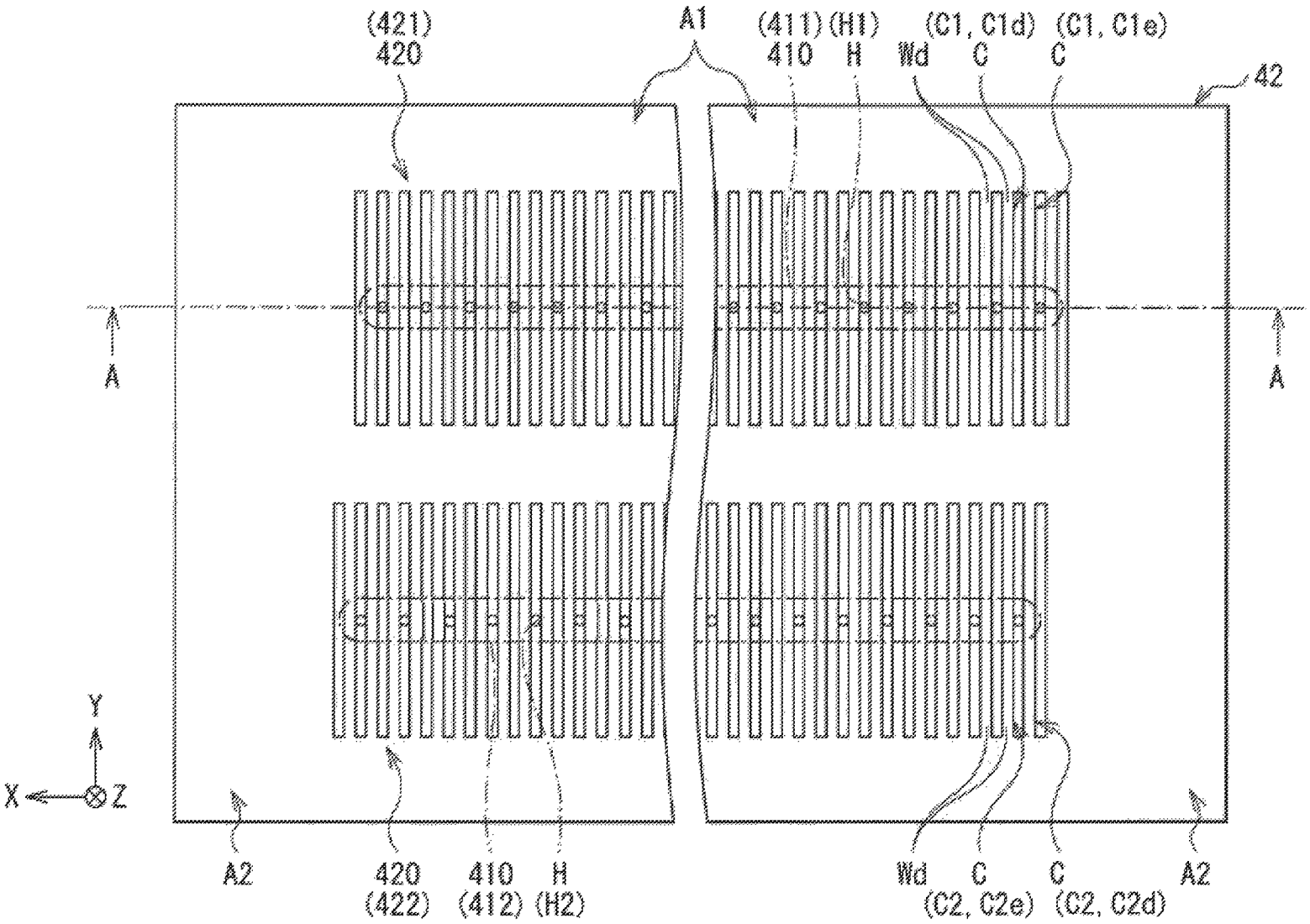
FIG. 5 is a plan view showing the configuration of the actuator plate shown in FIG. 4.
Figure 6:
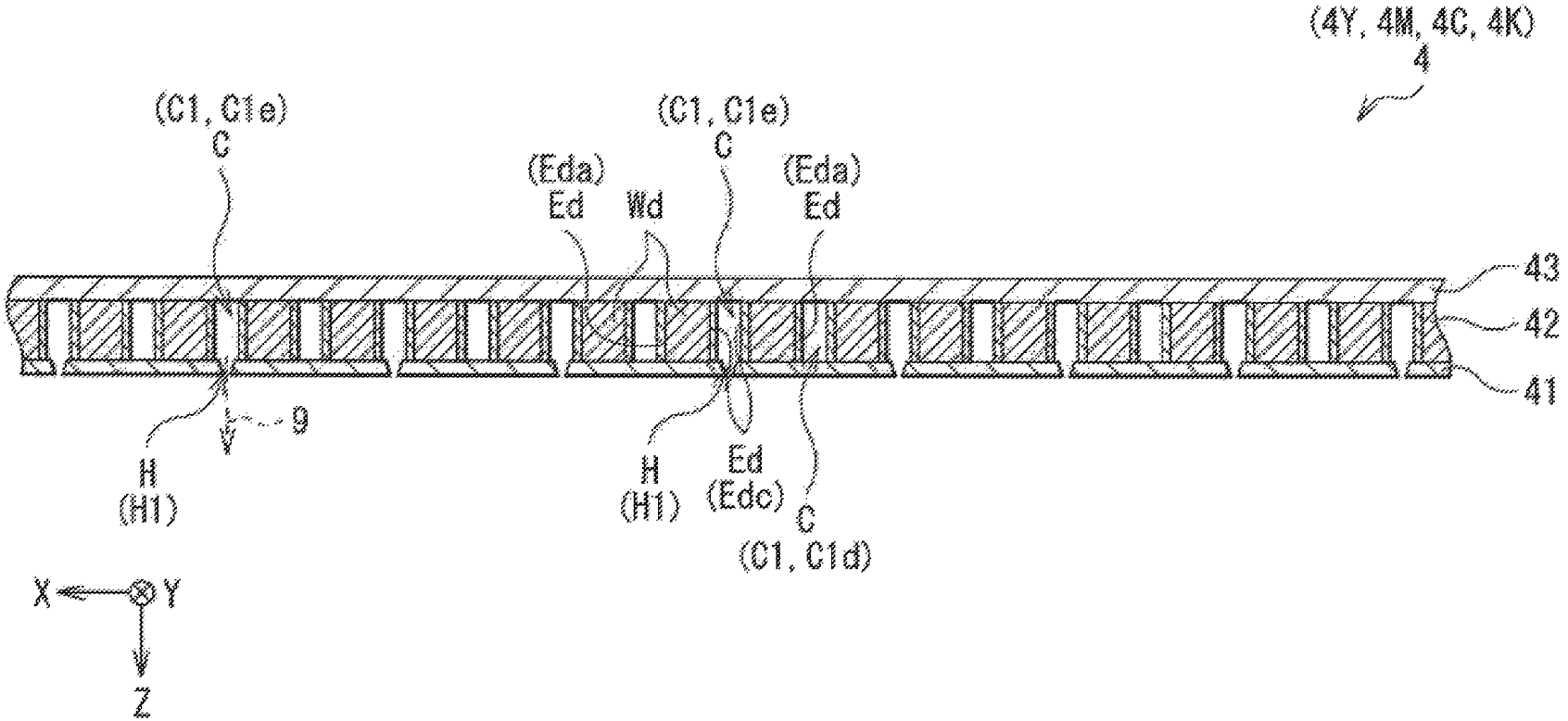
FIG. 6 is a cross-sectional view showing respective configurations of the nozzle plate, the actuator plate, and the cover plate along the line A-A shown in FIG. 5.
Figure 7:
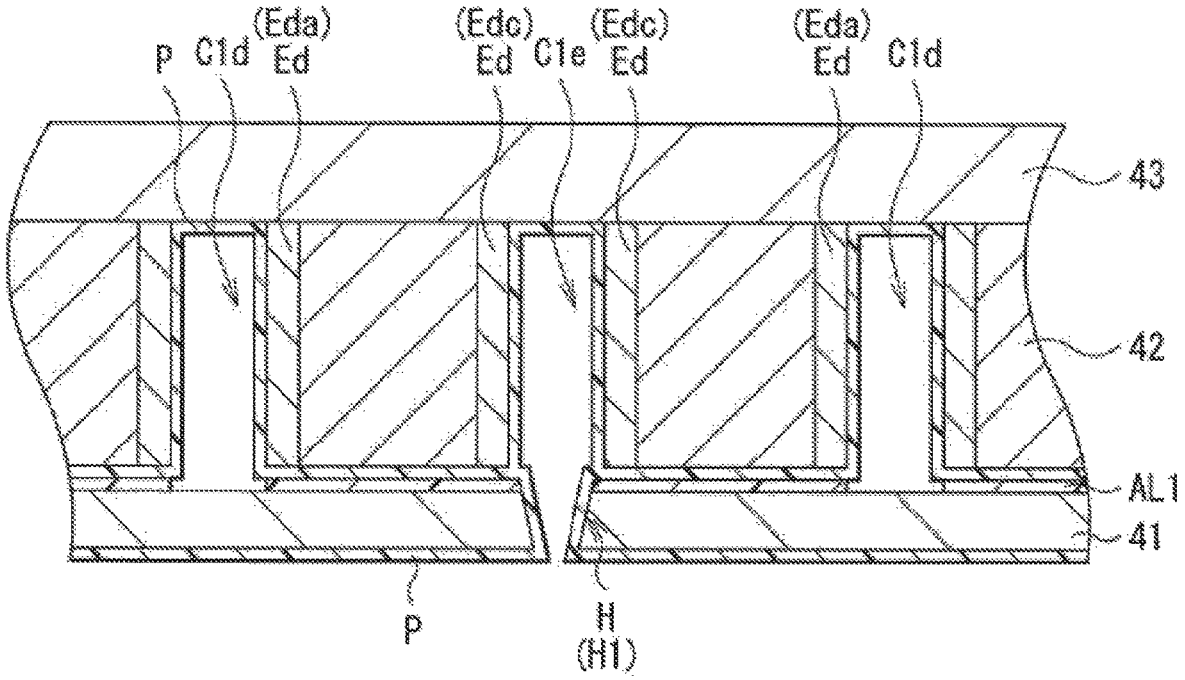
FIG. 7 is a cross-sectional view showing a part of FIG. 6 in an enlarged manner.

FIG. 5 shows a planar configuration of the actuator plate 42 shown in FIG. 4, and FIG. 6 shows respective cross sectional configurations of the nozzle plate 41, the actuator plate 42, and the cover plate 43 along the line A-A shown in FIG. 5. FIG. 7 shows, in an enlarged manner, a part corresponding to three channels C shown in FIG. 6.

It should be noted that in FIG. 5, nozzle columns 411, 412 (a plurality of nozzle holes H1, and a plurality of nozzle holes H2) are represented by the dotted lines.

[Nozzle Plate]

The nozzle plate 41 is a plate mainly provided with a plurality of nozzle holes H as a jet orifice of the ink 9 described later.

The nozzle plate 41 is bonded to one of the principal surfaces (an X-Z plane in FIG. 4 through FIG. 6) of the actuator plate 42 with an adhesive layer AL1 (FIG. 7). The nozzle plate 41 has a plurality of nozzle holes H at positions corresponding respectively to the plurality of channels C (ejection channels C1*e*, C2*e* described later). In the first embodiment, the nozzle plate 41 corresponds to a specific example of a "bonded plate" of the present disclosure.

Further, the nozzle plate 41 includes, for example, any one type or two or more types of insulating materials. The types of the insulating materials are not particularly limited, but are polymer materials such as polyimide. It should be noted that it is also possible for the nozzle plate 41 to include, for example, any one type or two or more types of conductive materials instead of the insulating materials. The types of the conductive materials are not particularly limited, but are metal materials such as stainless steel (SUS). The types of the stainless steel are not particularly limited, but are, for example, SUS316L and SUS304.

Specifically, the nozzle plate 41 has, for example, a plurality of nozzle columns 410 arranged at a predetermined distance in the Y-axis direction as shown in FIG. 4 through FIG. 6. The nozzle columns 410 each extend in, for example, the X-axis direction, and each include the plurality of nozzle holes H. The opening shape (the shape of the nozzle hole H viewed from the Z-axis direction) of the nozzle hole H is, for example, a circular shape.

Here, the nozzle plate 41 has, for example, two nozzle columns 410 (411, 412). Therefore, the inkjet head 4 is, for example, a so-called two-column type inkjet head.

The nozzle column 411 includes, for example, the plurality of nozzle holes H1 arranged at predetermined intervals in the X-axis direction. The nozzle holes H1 each extend in the Z-axis direction so as to penetrate the nozzle plate 41, and are communicated with the respective ejection channels C1*e* of the actuator plate 42 described later. Further, the nozzle holes H1 are each located at a position corresponding to a roughly central area of the ejection channel C1*e* extending in the Y-axis direction. The pitch (the distance between the two nozzle holes H1 adjacent to each other) of the plurality of nozzle holes H1 in the X-axis direction is substantially the same as, for example, the pitch (the distance between the two ejection channels C1*e* adjacent to each other) of the ejection channels C1*e* in the X-axis direction. Thus, the ink 9 supplied from the ejection channels C1*e* is jetted from the respective nozzle holes H1.

The nozzle column 412 has substantially the same configuration as that of, for example, the nozzle column 411 described above. Specifically, the nozzle column 412 includes, for example, the plurality of nozzle holes H2 arranged at predetermined intervals in the X-axis direction. The nozzle holes H2 each penetrate the nozzle plate 41, and are communicated with the respective ejection channels C2*e* of the actuator plate 42 described later. Further, the nozzle holes H2 are each located at a position corresponding to a roughly central area of the ejection channel C2*e* extending in the Y-axis direction. The pitch (the distance between the two nozzle holes H adjacent to each other) of the plurality of nozzle holes H2 in the X-axis direction is substantially the same as, for example, the pitch (the distance between the two ejection channels C2*e* adjacent to each other) of the plurality of ejection channels C2*e* in the X-axis direction. Thus, the ink 9 supplied from the ejection channels C2*e* is jetted from the respective nozzle holes H2.

In other words, the ink 9 having been supplied to each of the ejection channels C1*e*, C2*e* has contact with an area adjacent to the nozzle H1, H2 of the nozzle plate 41, and is then ejected. In other words, the nozzle plate 41 has surfaces (hereinafter referred to as a liquid contact surface of the nozzle plate 41) which the ink 9 having flowed into the ejection channels C1*e*, C2*e* has contact with. For example, the ink 9 has contact with a principal surface of the nozzle plate 41 at positions opposed to the ejection channels C1*e*, C2*e*, and an inner surface of each of the nozzle holes H1, H2. Here, the surfaces which the ink 9 having supplied to the ejection channels C1*e*, C2*e* has contact with out of the nozzle plate 41 correspond to a specific example of a "liquid contact surface" in the present disclosure.

The direction in which the ink 9 is jetted from each of the nozzle holes H1, H2 is the direction (the Z-axis direction) crossing the extending direction (the Y-axis direction) of the plurality of channels C as described above. More specifically, the jet direction of the ink 9 is a direction (the downward direction in FIG. 4) from the actuator plate 42 toward the nozzle plate 41. The inner diameter of each of the nozzle holes H1, H2 gradually decreases in a direction toward, for example, the jet direction. In other words, each of the nozzle holes H1, H2 is, for example, a penetration orifice having a tapered shape.

[Actuator Plate]

The actuator plate 42 is a plate electrically operating mainly for jetting the ink 9 from the plurality of nozzle holes H.

As described above, the actuator plate 42 has the plurality of channels C each extending in the Y-axis direction. The opening shape (the shape of the channel C viewed from the Z-axis direction) of the channel C is, for example, a rectangular shape. By housing the ink 9 in each of the channels C, the ink 9 is jetted from each of the nozzles H.

Further, the actuator plate 42 includes, for example, any one type or two or more types of piezoelectric materials. The types of the piezoelectric materials are not particularly limited, but are, for example, lead zirconium titanate (PZT) The actuator plate 42 is, for example, a stacked body (a chevron type) having two piezoelectric substrates stacked on one another, the two piezoelectric substrates being configured so that the respective polarization directions in the Z-axis direction are different from each other.

Specifically, the actuator plate 42 has, for example, a plurality of channel columns 420 arranged at a predetermined distance in the Y-axis direction as shown in FIG. 4 through FIG. 6. The channel columns 420 each extend in, for example, the X-axis direction, and each include the plurality of channels C. Here, the actuator plate 42 has, for example, the two channel columns 420 (421, 422).

In the actuator plate 42, for example, a jet area A1 of the ink 9 is disposed in roughly the central area (an area where the channel columns 421, 422 are formed) in the X-axis direction, and at the same time, non-jet areas A2 of the ink 9 are disposed in both end areas (the areas where the channel columns 421, 422 are not formed) in the X-axis direction. In other words, the non-jet areas A2 are disposed on the outer side of the jet area A1 in the X-axis direction.

The channel column 421 includes, for example, a plurality of channels C1 extending in the Y-axis direction. The plurality of channels C1 is, for example, arranged at predetermined intervals in the X-axis direction. Each of the channels C1 is partitioned by, for example, drive walls Wd each including a piezoelectric body. The drive wall Wd corresponds to a specific example of an "inner wall" in the present disclosure.

The channel column 422 has substantially the same configuration as that of, for example, the channel column 421 described above. Specifically, the channel column 422 includes, for example, a plurality of channels C2 extending in the Y-axis direction. The plurality of channels C2 is, for example, arranged at predetermined intervals in the X-axis direction. Each of the channels C2 is partitioned by, for example, the drive walls Wd each including a piezoelectric body.

The plurality of channels C1 includes, for example, the ejection channels C1*e* for jetting the ink 9 and dummy channels C1*d* not jetting the ink 9. In the channel column 421, the ejection channels C1*e* and the dummy channels C1*d* are alternately arranged in the X-axis direction, for example. The ejection channels C1*e* are communicated with the respective nozzle holes H1 provided to the nozzle plate 41. In contrast, the dummy channels C1*d* are not communicated with the respective nozzle holes H1, but are shielded by the nozzle plate 41.

The plurality of channels C2 has substantially the same configuration as that of, for example, the plurality of channels C1 described above. Specifically, the plurality of channels C2 includes, for example, the ejection channels C2*e* for jetting the ink 9 and dummy channels C2*d* not jetting the ink 9. In the channel column 422, the ejection channels C2*e* and the dummy channels C2*d* are alternately arranged in the X-axis direction, for example. The ejection channels C2*e* are communicated with the respective nozzle holes H2 provided to the nozzle plate 41. In contrast, the dummy channels C2*d* are not communicated with the respective nozzle holes H2, but are shielded by the nozzle plate 41. Here, the ejection channels C1*e*, C2*e* correspond to a specific example of an "ejection channel" in the present disclosure, and the dummy channels C1*d*, C2*d* correspond to a specific example of a "non-ejection channel" in the present disclosure.

The ejection channels C1*e* and the dummy channels C1*d*, and the ejection channels C2*e* and the dummy channels C2*d* are arranged in a staggered manner, for example. In other words, the ejection channels C1*e*, C2*e* are arranged in a zigzag manner, for example. It should be noted that in the actuator plate 42, in each of the areas corresponding respectively to the dummy channels C1*d*, C2*d*, there is disposed, for example, a shallow groove section Dd. The shallow groove section Dd is communicated with an outside end part of each of the dummy channels C1*d*, C2*d* extending in the Y-axis direction, for example.

In the actuator plate 42, for example, drive electrodes Ed extending in the Y-axis direction are disposed on inner side surfaces opposed to the drive walls Wd. The drive electrodes Ed include, for example, common electrodes Edc disposed on the respective inner side surfaces of the ejection channels C1*e*, C2*e*, and active electrodes Eda disposed on the respective inner side surfaces of the dummy channels C1*d*, C2*d*. Here, the common electrodes Edc correspond to a specific example of a "common electrode" in the present disclosure, and the active electrodes Eda correspond to a specific example of an "individual electrode" in the present disclosure. The drive electrodes Ed (the common electrodes Edc and the active electrodes Eda) each extend from one end part of the actuator plate 42 (the drive wall Wd) to the other end part in the Z-axis direction, for example. Therefore, the dimension of the drive electrode Ed in the Z-axis direction is made roughly equal to, for example, the thickness of the drive wall Wd in the Z-axis direction. The dimension of the drive electrode Ed in the Z-axis direction can be made smaller than the thickness of the drive wall Wd. As shown in FIG. 7, the drive electrode Ed is covered with a protective film P. Thus, the contact between the drive electrode Ed and the ink 9 is suppressed, and it becomes possible to suppress the occurrence of corrosion or the like of the drive electrode Ed.

The pair of common electrodes Edc opposed to each other inside one ejection channel C1*e* (or one ejection channel C2*e*) are, for example, electrically connected to each other via a common terminal. The pair of active electrodes Eda opposed to each other inside one dummy channel C1*d* (or one dummy channel C2*d*) are, for example, electrically separated from each other. The pair of active electrodes Eda opposed to each other via the ejection channel C1*e* (or the ejection channel C2*e*) are, for example, electrically connected to each other via an active terminal.

In the end part in the Y-axis direction of the actuator plate 42, for example, there is mounted a flexible printed circuit board 45 for electrically connecting the drive electrodes Ed and the inkjet head 4 to each other. It should be noted that in FIG. 4, outer edges (contours) of a part of the flexible printed circuit board 45 are represented by the dotted lines. Interconnections provided to the flexible printed circuit board 45 are electrically connected to, for example, the common terminals and the active terminals described above, respectively. Thus, the drive voltage is applied to each of the drive electrodes Ed from the inkjet head 4 via the flexible printed circuit board 45.

[Adhesive Layer]

Between the actuator plate 42 and the nozzle plate 41, there is disposed the adhesive layer AL1 as shown in FIG. 7. The adhesive layer AL1 is for bonding the actuator plate 42 and the nozzle plate 41 to each other, and is formed of a resin material such as epoxy resin, acrylic resin, or silicone resin. The adhesive layer AL1 is disposed so as to avoid the ejection channels C1*e*, C2*e* and the nozzle holes H1, H2 in order to prevent the adhesive layer AL1 from hindering the movement of the ink 9 from the ejection channels C1*e*, C2*e* to the nozzle holes H1, H2. Specifically, the adhesive layer AL1 is disposed between the drive wall Wd of the actuator plate 42 and a film member of the nozzle plate 41. It is preferable to dispose the adhesive layer AL1 so as to avoid areas between the dummy channels C1*d*, C2*d* and the nozzle plate 41 in order to prevent the adhesive layer AL1 from blocking the dummy channels C1*d*, C2*d*. Thus, the drive walls Wd are driven normally. Here, the adhesive layer AL1 corresponds to a specific example of an "adhesive layer" in the present disclosure.

[Protective Film]

As shown in FIG. 7, for example, the protective film P is provided to each of the plurality of ejection channels C1*e* (or ejection channels C2*e*) and the plurality of dummy channels C1*d* (or dummy channels C2*d*), and covers an inner side surface and a bottom surface of each of the ejection channels C1*e* and the dummy channels C1*d*. The protective film P covers the inner side surfaces of the ejection channel C1*e* and the dummy channel C1*d* across the drive electrodes Ed. The protective film P includes an organic insulating material such as a para-xylylene resin material (e.g., parylene (a registered trademark)). By forming the protective film P using the para-xylylene resin material, it becomes possible to prevent the infiltration of the ink 9 into the lower side of the protective film P to reliably protect members such as the drive electrodes Ed.

In the present embodiment, the protective film P covers an area from the inner side surface (the drive wall Wd) of the ejection channel C1*e* (or the ejection channel C2*e*) to the liquid contact surface (the surface adjacent to the nozzle holes H1, H2) of the nozzle plate 41 via the end surface of the adhesive layer AL1 exposed on the ejection channel C1*e* side. The protective film P is not required to cover the whole of the liquid contact surface of the nozzle plate 41, but is only required to be disposed so as to cover at least a part of the liquid contact surface of the nozzle plate 41 from the adhesive layer AL1 side. The protective film P is disposed continuously from the ejection channel C1*e* to the liquid contact surface of the nozzle plate 41 via the end surface of the adhesive layer AL1. Here, continuously disposing the protective film P means that an area where the protective film P is not disposed and a cut surface of the protective film P do not exist in an area from the ejection channel C1*e* to the liquid contact surface of the nozzle plate 41. The cut surface of the protective film P is formed by removing a part of the protective film P using, for example, asking.

Here, the protective film P continuously disposed as described above covers the end surface of the adhesive layer AL1 exposed on the ejection channel C1*e* side. Although described later in detail, thus, it becomes difficult for the ink 9 to infiltrate in the adhesive layer AL1 when the ink 9 is supplied to the ejection channel C1*e*. Further, out of the actuator plate 42, the adhesive layer AL1, and the nozzle plate 41, a part which the ink 9 has contact with is continuously covered with the protective film P. In other words, since the cut surface of the protective film P does not exist in the part which the ink 9 has contact with, the ink 9 is prevented from infiltrating in the lower side of the protective film P via the cut surface of the protective film P. It is also possible for the protective film P to be disposed on one principal surface (between the actuator plate 42 and the adhesive layer AL1) of the actuator plate 42 and an obverse surface (a surface opposite to the surface bonded to the actuator plate 42) of the nozzle plate 41. The protective film P is not required to be disposed on the obverse surface of the nozzle plate 41. For example, it is also possible to prevent the protective film P from being formed on the obverse surface of the nozzle plate 41 by bonding a film for a mask to the obverse surface of the nozzle plate 41 and then forming the protective film P.

Figure 8:
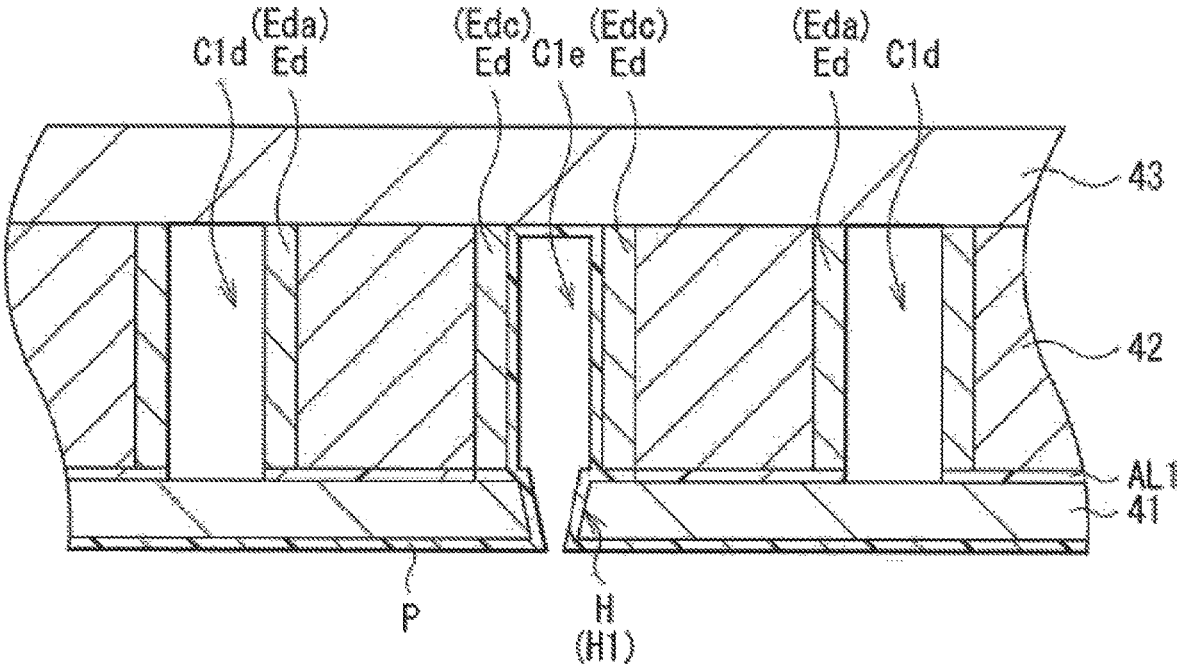
FIG. 8 is a cross-sectional view showing another example of the protective film shown in FIG. 7.

FIG. 8 shows another example of the configuration of the protective film P shown in FIG. 7. The protective film P is only required to be provided at least the ejection channel C1*e* out of the ejection channel C1*e* (or the ejection channel C2*e*) and the dummy channel C1*d* (or the dummy channel C2*d*). For example, the inner side surface and the bottom surface of the dummy channel C1*d* are not required to be covered with the protective film P (FIG. 8). The protective film P is not required to be disposed on one principal surface of the actuator plate 42 (FIG. 8).

As shown in FIG. 7, by providing the protective film P also to the dummy channel C1*d*, it is possible to prevent the active electrode Eda and the ink 9 from having contact with each other even if the ink 9 infiltrates in the dummy channel C1*d* from the end part in the extending direction (the Y-axis direction in FIG. 4 through FIG. 6) of the dummy channel C1*d* by projection or the like. Therefore, it becomes possible to suppress degradation of the reliability of the head chip 400.

[Cover Plate]

The cover plate 43 is a plate for mainly introducing the ink 9 into the actuator plate 42 (the plurality of channels C), and at the same time discharging the ink 9 from the actuator plate 42. The cover plate 43 is bonded to the other principal surface of the actuator plate 42.

The cover plate 43 includes, for example, substantially the same material as the constituent material of the actuator plate 42.

Specifically, as shown in FIG. 4 through FIG. 6, the cover plate 43 is disposed so as to shield the plurality of channels C1, C2 (the plurality of channel columns 421, 422) provided to the actuator plate 42.

The cover plate 43 has, for example, a pair of entrance side common ink chambers 431.*a*, 432.*a* and a pair of exit side common ink chambers 431*b*, 432*b*. The entrance side common ink chamber 431*a* and the exit side common ink chamber 431*b* are each disposed in, for example, an area corresponding to the channel column 421 (the plurality of channels C1) provided to the actuator plate 42. The entrance side common ink chamber 432*a* and the exit side common ink chamber 432*b* are each disposed in, for example, an area corresponding to the channel column 422 (the plurality of channels C2) provided to the actuator plate 42.

The entrance side common ink chamber 431*a* is disposed at a position corresponding to one end part (an inside end part) of each of the channels C1 extending in the Y-axis direction. In the entrance side common ink chamber 431*a*, in an area corresponding to each of the ejection channels C1*e*, there is formed, for example, a supply slit Sa. Further, the entrance side common ink chamber 432*a* is disposed at a position corresponding to one end part (an inside end part) of each of the channels C2 extending in the Y-axis direction. In the entrance side common ink chamber 432*a*, in an area corresponding to each of the ejection channels C2*e*, there is formed, for example, the supply slit Sa similarly to the entrance side common ink chamber 431*a* described above.

The exit side common ink chamber 431*b* is disposed separately from the entrance side common ink chamber 431*a*, and is arranged at a position corresponding to the other end part (an outside end part) of each of the channels C1 extending in the Y-axis direction. In the exit side common ink chamber 431*b*, in an area corresponding to each of the ejection channels C1*e*, there is formed, for example, a discharge slit Sb. Further, the exit side common ink chamber 432*b* is disposed separately from the entrance side common ink chamber 432*a*, and is arranged at a position corresponding to the other end part (an outside end part) of each of the channels C2 extending in the Y-axis direction. In the exit side common ink chamber 432*b*, in an area corresponding to each of the ejection channels C2*e*, there is formed, for example, the discharge slit Sb similarly to the exit side common ink chamber 431*b* described above.

The entrance side common ink chamber 431*a* and the exit side common ink chamber 431*b* are each communicated with each of the ejection channels C1*e* via the supply slit Sa and the discharge slit Sb on the one hand, but are not communicated with each of the dummy channels C1*d* on the other hand. Specifically, each of the dummy channels C1*d* is shielded by the entrance side common ink chamber 431*a* and the exit side common ink chamber 431*b*.

The entrance side common ink chamber 432*a* and the exit side common ink chamber 432*b* are each communicated with each of the ejection channels C1*e* via the supply slit Sa and the discharge slit Sb on the one hand, but are not communicated with each of the dummy channels C2*d* on the other hand. Specifically, each of the dummy channels C2*d* is shielded by the entrance side common ink chamber 432*a* and the exit side common ink chamber 432*b*.

Here, the entrance side common ink chambers 431*a*, 432*a* and the supply slits Sa correspond to a specific example of a "liquid introduction flow channel" in the present disclosure, and the exit side common ink chambers 431*b*, 432*b* and the discharge slits Sb correspond to a specific example of a "liquid discharge flow channel" in the present disclosure.

[Flow Channel Plate]

As shown in FIG. 2, the flow channel plate 44 is disposed on the upper surface of the cover plate 43, and has a predetermined flow channel (not shown) through which the ink 9 flows. Further, to the flow channel in such a flow channel plate 44, there are connected the flow channels in the circulation mechanism 5 described above so as to achieve inflow of the ink 9 to the flow channel and outflow of the ink 9 from the flow channel, respectively. It should be noted that since it is arranged that the dummy channels C1*d*, C2*d* are closed by the bottom part of the cover plate 43 as described above, the ink 9 is supplied only to the ejection channels C1*e*, C2*e*, but does not inflow into the dummy channels C1*d*, C2*d*, <1-3. Method of Manufacturing Inkjet Head 4>

Figure 9:
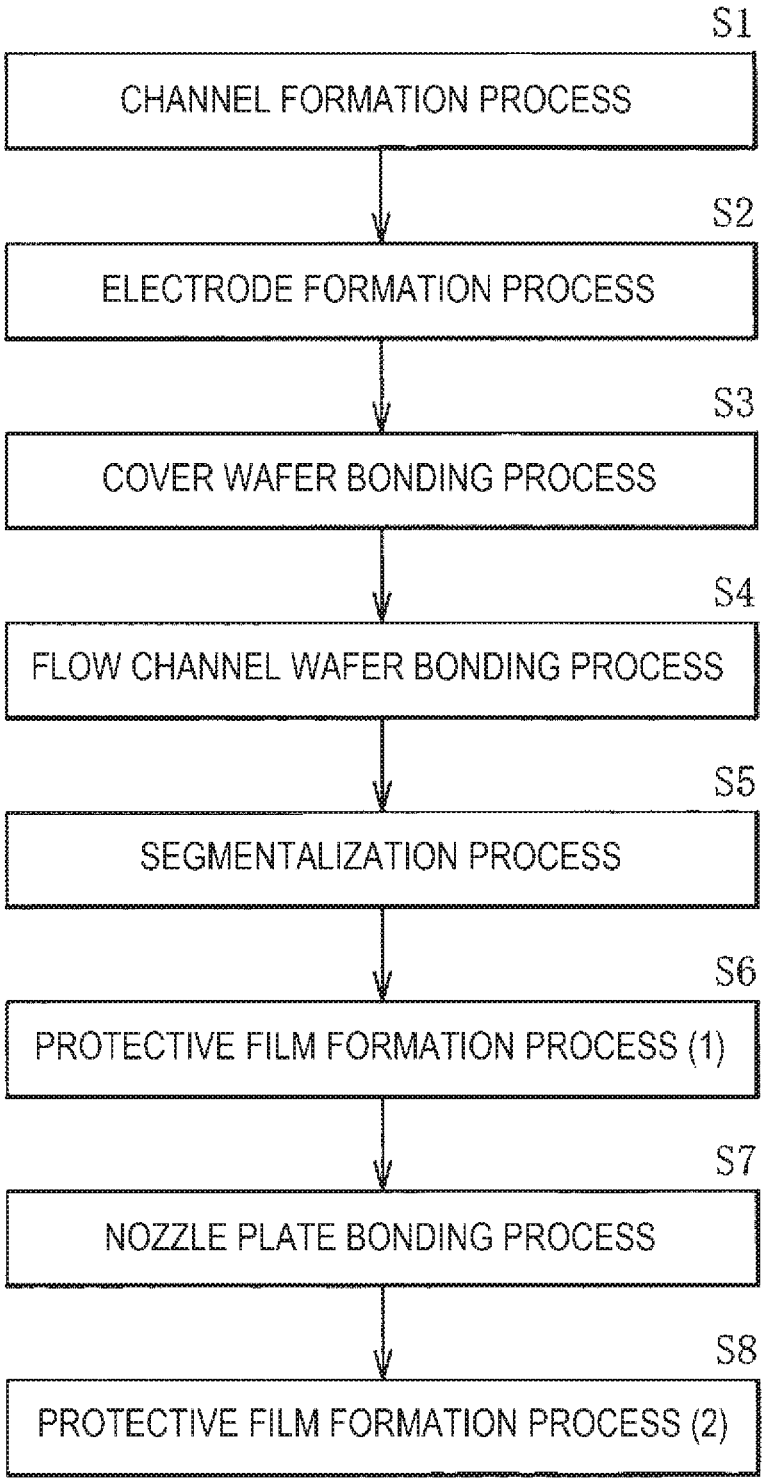

Then, a method of manufacturing the inkjet head 4 will be described using FIG. 9. FIG. 9 is a diagram showing an example of the method of manufacturing the inkjet head 4 in the order of the processes.

Firstly, an actuator wafer is formed using a channel formation process (step S1) and an electrode formation process (step S2). By segmentalizing (step S5) the actuator wafer, a plurality of actuator plates 42 is formed. Specifically, for example, the actuator wafer is formed in the following manner.

Firstly, a piezoelectric substrate formed of a piezoelectric material such as PZT is prepared. The piezoelectric substrate is formed of, for example, a stacked body of two piezoelectric substrates having the respective polarization directions in the thickness direction opposite to each other. Subsequently, on a surface of the piezoelectric substrate, there is formed a pattern of the resist film using, for example, a photolithography method. Subsequently, grinding processing is performed from the surface of the piezoelectric substrate provided with a pattern of the resist film to form a plurality of grooves. Thus, the channels C1, C2 are formed (step S1).

Then, a metal material is deposited on the inner side surface of each of the channels C2 using, for example, an oblique vapor deposition method. Thus, the drive electrodes Ed are formed (step S2). Subsequently, by removing the resist film, the active electrodes Eda formed in the ejection channels C1*e* (or the ejection channels C2*e*) and the common electrodes Edc formed in the dummy channels C2*d* (or the dummy channels C2*d*) are electrically separated (a liftoff process).

After forming the actuator wafer in such a manner, a cover wafer is bonded (step S3) on a surface of the actuator wafer with an adhesive. Subsequently, a flow channel wafer is bonded (step S4) on a surface of the cover wafer with an adhesive. By segmentalizing (step S5) the cover wafer, the plurality of cover plates 43 is formed, and by segmentalizing (step S5) the flow channel wafer, the plurality of flow channel plates 44 is formed.

After bonding the cover wafer and the flow channel wafer to the actuator wafer in this order, these stacked bodies are segmental zed (step S5) into chips using, for example, a dicer. Thus, the actuator plate 42, the cover plate 43, and the flow channel plate 44 bonded to each other are formed.

Then, the protective film P is formed (step S6) on one principal surface (a principal surface on an opposite side to the principal surface to which the cover plate 43 has been bonded) of the actuator plate 42 and inside the channels C2. The protective film P is formed by depositing a paraxylylene resin material using, for example, a chemical vapor deposition method. The protective film P is deposited continuously from one principal surface of the actuator plate 42 to the inner side surfaces and the bottom surfaces of the channels C1, C2 via the openings of the channels C1, C2. After forming the protective film P, a surface treatment such as plasma irradiation is performed on the one principal surface of the actuator plate 42. Thus, when bonding (step S7) the nozzle plate 41 to the actuator plate 42, a decrease in adhesive force due to the protective film P can be suppressed.

Subsequently, the nozzle plate 41 is bonded (step S7) to the one principal surface of the actuator plate 42 via the adhesive layer AL1. Subsequently, the protective film P is formed (step S8) continuously from the surface of the nozzle plate 41 to the inside of the ejection channels C1*e*, C2*e* via the nozzle holes H1, H2, respectively. Thus, the protective film P is formed continuously from an area adjacent to the nozzle hole H1. H2 to the inside of the ejection channel C1*e*, C2*e* via the end surface of the adhesive layer ALT exposed on the ejection channel C1*e*, C2*e* side. In such a manner, it is possible to manufacture the inkjet head 4 shown in FIG. 2 through FIG. 7 and so on.

Figure 10:
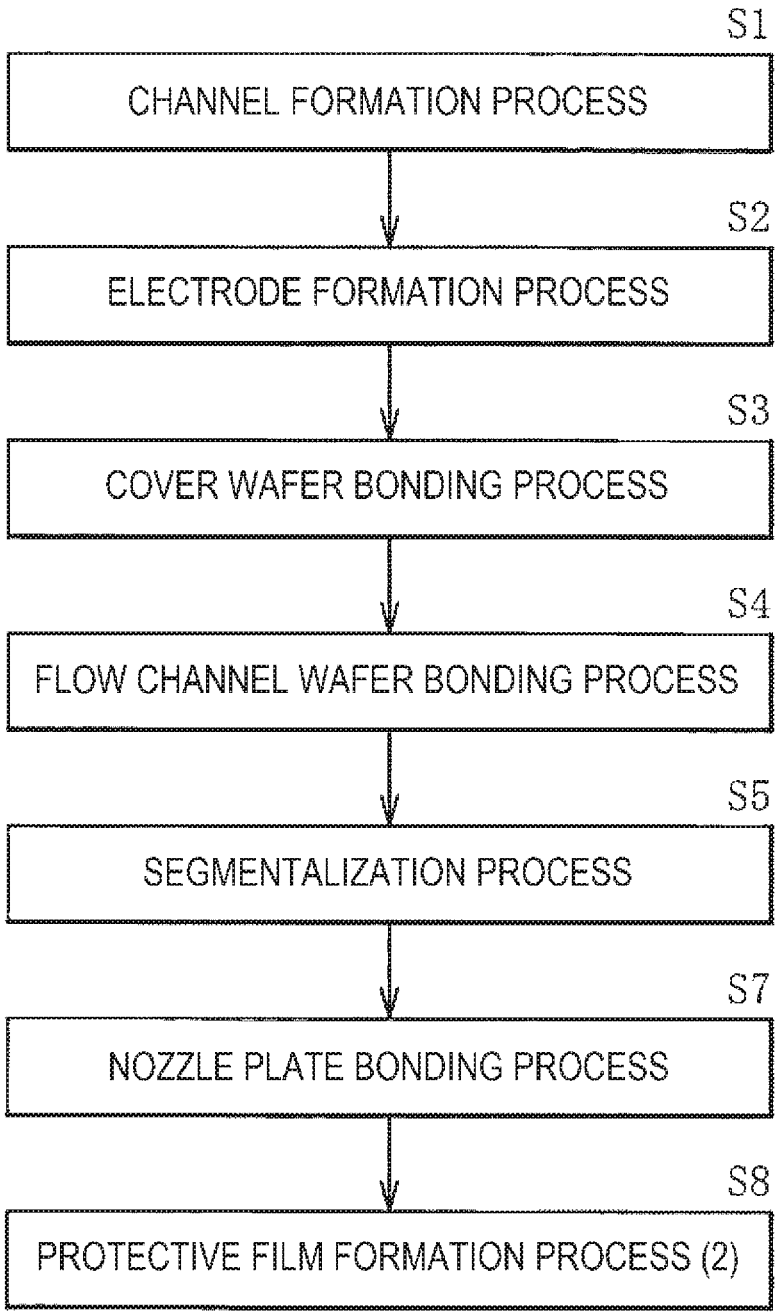
FIG. 10 is a process chart showing another example of the method of manufacturing the liquid jet head shown in FIG. 9.

FIG. 10 is a diagram showing another example of the method of manufacturing the inkjet head 4. As described in the drawing, it is possible to arrange to perform the formation process of the protective film P just once. In this manufacturing method, the protective film P is formed (step S8) after the process in the step S7 without performing the formation process (step S6 in FIG. 9) of the protective film P prior to the bonding process (step S7) of the nozzle plate 41. In this manufacturing method, the protective film P is not formed (see FIG. 8) on the inner side surfaces and the bottom surfaces of the dummy channels C1*d*, C2*d*.

Here, the inkjet head 4 (the head chip 400) is a side-shoot type, and the nozzle holes H1, H2 are communicated with the openings of the ejection channels C2*e* disposed on the one principal surface of the actuator plate 42. In such a side-shoot type inkjet head 4, the openings of the ejection channels C1*e*, C2*e* are made larger compared to the edge-shoot type inkjet head (e.g., an inkjet head 4B shown in FIG. 20 described later). Therefore, even when forming (step S8) the protective film P after bonding the actuator plate 42 and the nozzle plate 41 to each other via the adhesive layer AL1, it is easy for the resin material for forming the protective film P to flow in a communication part where the ejection channels C1*e* C2*e* are communicated with the nozzle holes H1, H2. Thus, it becomes easy to form the protective film P for covering the end surface of the adhesive layer AL1 exposed on the ejection channel C1*e*, C2*e* side to have a large thickness.

Further, the inkjet head 4 (the head chip 400) has an introduction flow channel of the ink 9 from the ink tank 3, and a discharge flow channel of the ink 9 to the ink tank 3. In other words, the inkjet head 4 is a circulation type inkjet head, and the fluid is made easier to move compared to the non-circulation type inkjet head. Therefore, even when forming (step S8) the protective film P after bonding the actuator plate 42 and the nozzle plate 41 to each other via the adhesive layer AL1, it is easy for the resin material for forming the protective film P to flow in the communication part where the ejection channels C1*e*, C2*e* are communicated with the nozzle holes H1, H2. Also in this regard, it is easy to form the protective film P for covering the end surface of the adhesive layer AL1 exposed on the ejection channel C1*e*, C2*e* side to have a large thickness.

<1-4. Operations>

Then, the operations of the printer 1 will be described.

[Operations of Printer]

Firstly, an overall operation of the printer 1 will be described. In this printer 1, an image and so on are recorded on the recording paper P in the following procedure.

In the initial state, the ink 9 of the four colors (yellow, magenta, cyan, and black) different from each other are respectively contained in the four ink tanks 3 (3Y, 3M, 3C, and 3K). The ink 9 is circulated in the circulation mechanism 5 to thereby be supplied to the inkjet head 4.

When the printer 1 operates, the grit rollers 21 of the respective carrying mechanisms 2*a*, 2*b* rotate, and therefore, the recording paper P is carried in the carrying direction D by the grit rollers 21 and the pinch rollers 22. In this case, due to the drive of the drive mechanism 63 (the drive motor 633), the pulleys 631*a*, 631*b* rotate to thereby operate the belt 632. Further, the carriage 62 reciprocates in the Y-axis direction using the guide rails 61*a*, 61*b*. Thus, since the four colors of ink 9 are jetted from the four inkjet heads 4 (4Y, 4M, 4C, and 4K) to the recording paper P, the image and so on are recorded on the recording paper P.

[Operations of Inkjet Heads]

Then, the operations of the inkjet heads 4 when the printer 1 is in operation will be described. In each of the inkjet heads 4, the ink 9 is jetted to the recording paper P using a shear mode in the following procedure.

Firstly, when the carriage 62 reciprocates, the drive voltages are applied to the drive electrodes Ed (the common electrodes Edc and the active electrodes Eda) in the inkjet head 4 via the flexible printed circuit board 45. Specifically, the drive voltage is applied to the respective drive electrodes Ed provided to the pair of drive walls Wd defining each of the ejection channels C1*e*, C2*e*. Thus, the pair of drive walls Wd each deform so as to protrude toward the dummy channel C1*d*, C2*d* adjacent to the ejection channel C1*e*, C2*e*.

Here, as described above, in the actuator plate 42, the two piezoelectric substrates configured so that the polarization directions in the Z-axis direction are different from each other are stacked on one another, and at the same time, the drive electrode Ed extends in the Z-axis direction from one end part of each of the drive walls Wd to the other end part. In this case, by applying the drive voltage to the drive electrodes Ed, the drive wall Wd makes flexural deformation taking a roughly middle position of the drive wall Wd in the Z-axis direction as an origination due to the piezoelectric thickness-shear effect. Thus, each of the ejection channels C1*e*, C2*e* deforms as if it bulges using the flexural deformation of the drive wall Wd described above.

The capacity of each of the ejection channels C1*e*, C2*e* increases using the flexural deformation of the pair of drive walls Wd based on the piezoelectric thickness-shear effect described above. Thus, the ink 9 having retained in each of the entrance side common ink chambers 431*a*, 432*a* is induced into the inside of each of the ejection channels C1*e*, C2*e*.

Subsequently, the ink 9 having been induced into the inside of each of the ejection channels C1*e*, C2*e* propagates to the inside of each of the ejection channels C1*e*, C2*e* as a pressure wave. In this case, the drive voltage to be applied to the drive electrodes Ed becomes zero (0 V) at the timing at which the pressure wave has reached the nozzle hole H1, H2 provided to the nozzle plate 41. Thus, the drive walls Wd having flexurally deformed are restored to the original state, and therefore, the capacity of each of the ejection channels C1*e*, C2*e* is restored.

Lastly, when the capacity of each of the ejection channels C1*e*, C2*e* is restored, the pressure increases in the inside of each of the ejection channels C1*e*, C2*e*, and therefore, the ink 9 having been induced into the inside of each of the ejection channels C1*e*, C2*e* is pressurized. Thus, the ink 9 shaped like a droplet is jetted from each of the nozzle holes H1, H2 toward the outside (the recording paper P).

In this case, for example, since the inner diameter of each of the nozzle holes H1, H2 gradually decreases toward the jet direction as described above, the jet speed of the ink 9 increases, and at the same time, the straightness of the ink 9 is improved. Thus, the quality of the image and so on to be recorded on the recording paper P is improved.

<1-5. Functions and Advantages>

Then, the functions and the advantages of the printer 1 equipped with the inkjet heads 4 will be described.

In the head chip 400, the inkjet head 4, and the printer 1 according to the present embodiment, the protective film P covers the area from the inside of the ejection channel C1*e*, C2*e* to the liquid contact surface of the nozzle plate 41 via the end surface of the adhesive layer AL1 exposed on the ejection channel C1*e*, C2*e* side is covered with the protective film P. In other words, the entire area of the end surface of the adhesive layer AL1 exposed on the ejection channel C1*e*, C2*e* side. Thus, it becomes difficult for the ink 9 located inside the ejection channel C1*e*, C2*e* to infiltrate in the adhesive layer AL1. Hereinafter, the functions and the advantages will be described using a comparative example.

Figure 11:
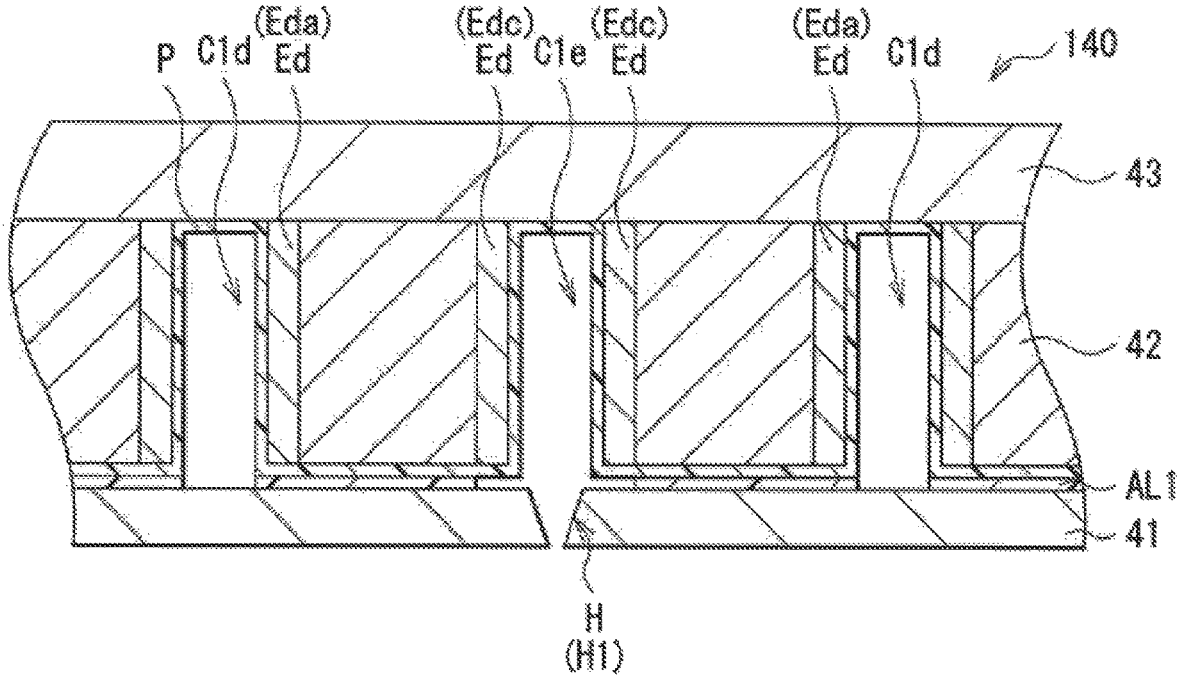
FIG. 11 is a cross-sectional view showing a configuration of a substantial part of a liquid jet head related to a comparative example.

FIG. 11 is a diagram schematically showing a cross-sectional configuration of a substantial part of the head chip 140 related to the comparative example, and shows a part corresponding to FIG. 7. In the head chip 140 related to this comparative example, the protective film P fails to cover the end surface of the adhesive layer AL1 exposed on the ejection channel C1*e*, C2*e* side. The protective film P is a film formed before bonding the nozzle plate 41 to the actuator plate 42 via, for example, the adhesive layer AL1, and covers the inner side surfaces and the bottom surfaces of the ejection channel C1*e* and the dummy channel C1*d* from the surface (the surface bonded to the nozzle plate 41) of the actuator plate 42.

In such a head chip 140, since the ink 9 having been induced into the ejection channel C1*e* has direct contact with the adhesive layer AL1, the ink 9 is apt to infiltrate in the adhesive layer AL1 via the end surface. The ink 9 having infiltrated in the adhesive layer AL1 moves inside the adhesive layer AL1. Thus, there is a possibility that an ingredient of the ink 9 distills from the ejection channel C1*e* to the dummy channel C1*d* via the adhesive layer AL1. When the ingredient of the ink 9 distills from the ejection channel C1*e* to the dummy channel C1*d*, there is a possibility that there occurs short circuit between the common electrode Edc provided to the ejection channel C1*e* and the active electrode Eda provided to the dummy channel C1*d*. Further, there is a possibility that the ink 9 having infiltrated in the adhesive layer ALA decreases the adhesive force of the adhesive layer AL1 to separate the nozzle plate 41 from the actuator plate 42. Thus, in the head chip 140, the reliability decreases.

In contrast, in the head chip 400, the protective film P is formed (step S8 in FIG. 9 and FIG. 10) after bonding the nozzle plate 41 to the actuator plate 42, and the end surface of the adhesive layer AL1 exposed on the ejection channel C1*e*, C2*e* side is covered with the protective film P. Thus, the ink 9 in the ejection channel C1*e*, C2*e* does not have direct contact with the end surface of the adhesive layer AL1, and is prevented from infiltrating in the adhesive layer AL1. Therefore, it is possible to prevent occurrence of the short circuit between the common electrode Edc and the active electrode Eda and a decrease in the adhesive force of the adhesive layer AL1 due to the ink 9 having infiltrated in the adhesive layer AL1. Therefore, in the head chip 400, it becomes possible to suppress degradation of the reliability compared to the head chip 140.

Further, here, the surface treatment such as plasma irradiation is performed on the surface of the actuator plate 42 before bonding the nozzle plate 41 (step S7 in FIG. 9 and FIG. 10). Thus, it is possible to form the protective film P continuing from the ejection channel C1*e*, C2*e* to the liquid contact surface of the nozzle plate 41.

For example, it is also conceivable to perform ashing on the surface of the actuator plate 42 to remove the protective film P having been deposited on the surface of the actuator plate 42 after forming the protective film P (step S6 in FIG. 9). By removing the protective film P on the surface of the actuator plate 42 in advance, it is possible to enhance the adhesiveness between the actuator plate 42 and the nozzle plate 41. However, when performing such ashing on the protective film P, the cut surface is provided to the protective film P, and it becomes easy for the ink 9 to infiltrate on a lower side of the protective film P from the cut surface. Therefore, it becomes unachievable to sufficiently maintain the protective function of the protective film P. Thus, there is a possibility that there occurs a failure of the drive electrode Ed and so on due to the ingredient of the ink 9. The failure of the drive electrode Ed denotes, for example, corrosion of the drive electrode Ed and short circuit of the drive electrode Ed due to the ingredient of the ink 9.

Here, as described above, after forming the protective film P on the actuator plate 42, the surface treatment such as plasma irradiation is performed on the surface of the actuator plate 42 instead of ashing. Therefore, it is possible to bond the actuator plate 42 to the nozzle plate 41 with sufficient strength without damaging the protective function of the protective film P. Therefore, it is possible to prevent the failure of the drive electrode Ed caused by a decrease in protective function of the protective film P from occurring to thereby suppress the degradation of the reliability of the head chip 400.

As described above, in the head chip 400, the inkjet head 4, and the printer 1 according to the present embodiment, since the end surface of the adhesive layer AL1 exposed on the ejection channel C1*e*, C2*e* side is covered with the protective film P, the ink 9 in the ejection channel C1*e*, C2*e* becomes difficult to infiltrate in the adhesive layer AL1. Thus, it becomes possible to suppress the degradation of the reliability of the head chip 400, the inkjet head 4, and the printer 1 caused by the infiltration of the ink 9 in the adhesive layer ALL In other words, it becomes possible to reduce an influence on members adjacent to the ejection channel C1*e*, C2*e* due to the ink 9 supplied to the ejection channel C1*e*, C2*e* to thereby suppress the degradation of the reliability.

Further, since the protective film P is formed continuously from the inside of the ejection channel C1*e*, C2*e* to the liquid contact surface of the nozzle plate 41 via the end surface of the adhesive layer ALA, the decrease in the protective function of the protective film P is prevented. Also in this regard, it becomes possible to suppress the degradation of the reliability of the head chip 400, the inkjet head 4, and the printer 1.

In particular, in the head chip 400 which is of the side-shoot type of the circulation type, the fluid is made easy to move through the flow channel in the head chip 400. Therefore, it is possible to easily form the protective film P having the sufficiently large thickness on the end surface of the adhesive layer AL1 exposed on the ejection channel C1*e*, C2*e* side.

Subsequently, a modified example of the first embodiment described above and other embodiments will be described. It should be noted that hereinafter, substantially the same constituents as those in the first embodiment are denoted by the same reference symbols, and the description thereof will arbitrarily be omitted.

2. Modified Example

Figure 12:
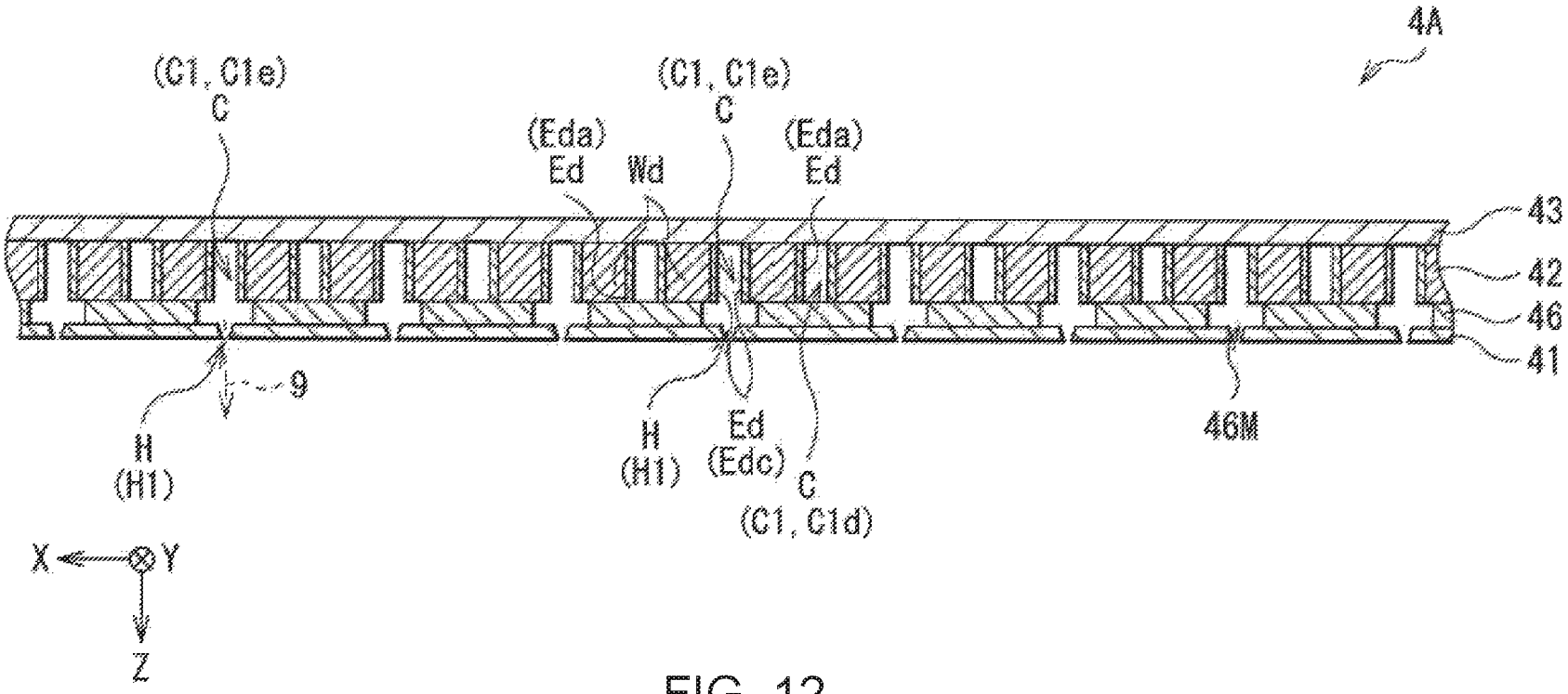
FIG. 12 is a cross-sectional view showing a configuration of a substantial part of a liquid jet head related to a modified example.
Figure 13:
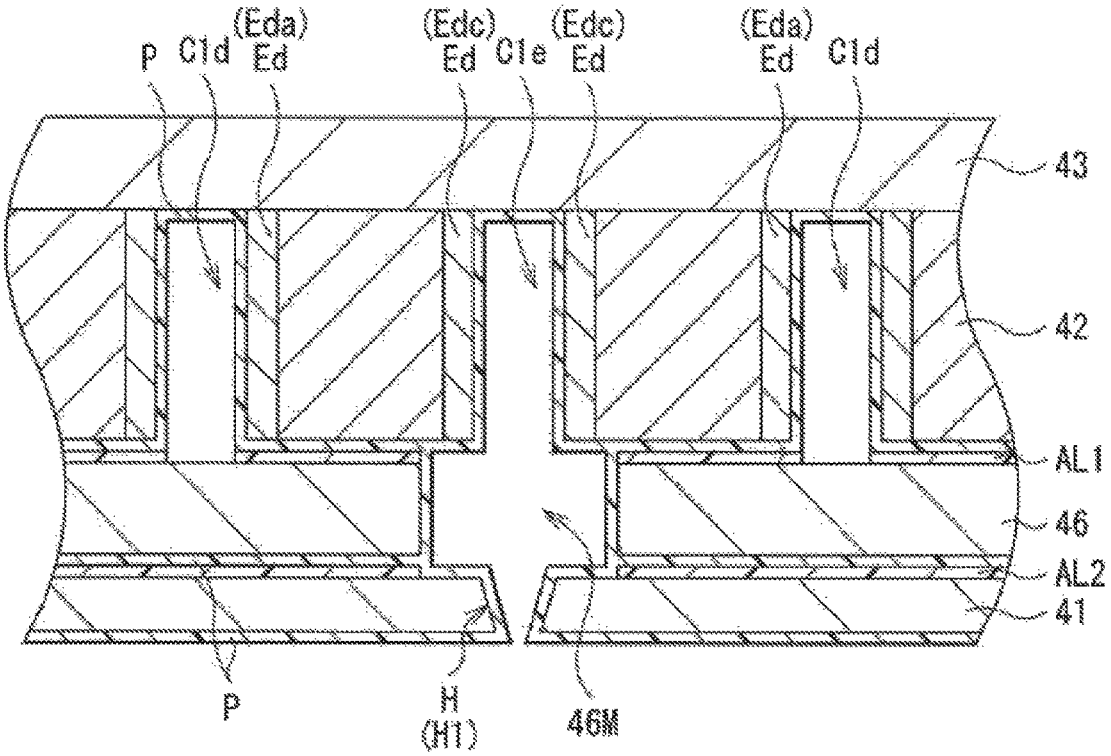
FIG. 13 is a cross-sectional view showing a part of FIG. 12 in an enlarged manner.

FIG. 12 and FIG. 13 show a cross-sectional configuration of a substantial part of an inkjet head 4A according to the modified example of the first embodiment described above. FIG. 12 corresponds to FIG. 6 showing the inkjet head 4 according to the first embodiment described above. FIG. 13 is a diagram showing, in an enlarged manner, the part corresponding to the three channels C shown in FIG. 12, and corresponds to FIG. 7 showing the inkjet head 4 in the first embodiment described above. The inkjet head 4A related to the modified example has an intermediate plate 46 disposed between the nozzle plate 41 and the actuator plate 42. The inkjet head 4A has substantially the same configuration as that of the inkjet head 4 except this point, and can obtain substantially the same advantages as those of the inkjet head 4 according to the first embodiment.

The intermediate plate 46 is, for example, a plate which intervenes between the nozzle plate 41 and the actuator plate 42 to thereby be used for aligning the nozzle plate 41 and the actuator plate 42 with each other. The intermediate plate 46 is only required to be disposed between the nozzle plate 41 and the actuator plate 42, and can assume another role, for example. Between the intermediate plate 46 and the actuator plate 42, there is disposed the adhesive layer AL1, and by the adhesive layer AL1, the intermediate plate 46 is bonded to the actuator plate 42. In the present modified example, the intermediate plate 46 corresponds to a specific example of a "bonded plate" in the present disclosure, and the adhesive layer AL1 corresponds to a specific example of the "adhesive layer" in the present disclosure.

Between the intermediate plate 46 and the nozzle plate 41, there is disposed an adhesive layer AL2, and by the adhesive layer AL2, the nozzle plate 41 is bonded to the intermediate plate 46. The adhesive layer AL2 is formed of a resin material including, for example, epoxy resin, acrylic resin, or silicone resin.

By making the intermediate plate 46 intervene between the nozzle plate 41 and the actuator plate 42, the adhesive layer AL2 between the intermediate plate 46 and the nozzle plate 41 is formed in addition to the adhesive layer AL1 between the intermediate plate 46 and the actuator plate 42. In other words, the bonding area between the plates increases, and separation between the plates becomes difficult to occur. Therefore, in the inkjet head 4A, it becomes possible to prevent the separation between the plates to thereby enhance the reliability.

The intermediate plate 46 includes, for example, any one type or two or more types of insulating materials, and therefore has an insulation property. The types of the insulating materials are not particularly limited, but are polymer materials such as polyimide or poly-paraxylene.

The nozzle plate 41 and the actuator plate 42 are bonded to each other via the intermediate plate 46. Thus, the nozzle plate 41 having conductivity and the actuator plate 42 having conductivity are electrically separated (insulated) from each other via, for example, the intermediate plate 46 having an insulation property. Therefore, even when the conductive material is used as a constituent material of the nozzle plate 41, it is possible to prevent the short circuit between the nozzle plate 41 and the actuator plate 43 via the ink 9 from occurring.

The intermediate plate 46 has communication holes 46M at positions respectively corresponding to, for example, the ejection channels C1*e* (or the ejection channels C2*e*) and the nozzle holes H1 (or the nozzle holes H2). The communication holes 46M penetrate the intermediate plate 46 in the thickness direction (the Z direction in FIG. 12 and FIG. 13), and are communicated with the ejection channels C1*e* and the nozzle holes H1 Here, the communication hole 46M corresponds to a specific example of a "communication hole" in the present disclosure. It is arranged that the ink 9 having been supplied to the ejection channel C1*e* passes through the communication hole 46 of the intermediate plate 46, and is then jetted from the nozzle hole H1. In other words, the intermediate plate 46 has a surface (hereinafter referred to as a liquid contact surface of the intermediate plate 46) which the ink 9 having flowed into the ejection channel C1*e*, C2*e* has contact with. For example, the ink 9 has contact with an inner surface of the communication hole 46M. Here, the surfaces which the ink 9 having supplied to the ejection channels C1*e*, C2*e* has contact with out of the intermediate plate 46 correspond to a specific example of a "liquid contact surface" in the present disclosure. The adhesive layer AL2 is disposed so as to avoid the communication holes 46M and the nozzle holes H1, H2 in order to prevent the adhesive layer AL2 from hindering the movement of the ink 9 from the communication holes 46M to the nozzle holes H1, H2.

The communication hole 46M is disposed at, for example, a position corresponding to the ejection channel C1*e* so as to have a slit-like shape. The communication hole 46M having the slit-like shape extends, for example, in roughly parallel (the Y-axis direction in FIG. 12) to the extending direction of the ejection channel C1*e*. For example, when the intermediate plate 46 assumes the role of alignment between the nozzle plate 41 and the actuator plate 42 as described above, it is preferable for the size of the width (the size in the X-axis direction in FIG. 12) of the communication hole 46M to be larger than, for example, the size of the width of the ejection channel C1*e*. When the width of the ejection channel C1*e* is sufficiently large, it is possible for the width of the communication hole 46M to be the same as the size of the width of the ejection channel C1*e*, or to be made smaller than the size of the width of the ejection channel C1*e*. It is also possible for the communication hole 46M to have, for example, a roughly circular planer shape, and it is also possible for the communication holes each having the roughly circular shape to be disposed at positions corresponding to the nozzle holes M. The opening of the dummy channel C1*d*. (or the dummy channel C2*d*) disposed on one principal surface of the actuator plate 42 is closed by the intermediate plate 46.

The protective film P is disposed continuously from the inside of the ejection channels C1*e* to the liquid contact surface of the nozzle plate 41 via the end surface of the adhesive layer AL1 exposed on the ejection channel C1*e* side, the liquid contact surface of the intermediate plate 46, and the end surface of the adhesive layer AL2 exposed on the communication hole 46M side (FIG. 13). It is also possible for the protective film P to be disposed on one principal surface of the actuator plate 42, a surface (an opposite surface to the surface bonded to the actuator plate 42), and the surface of the nozzle plate 41.

Figure 14:
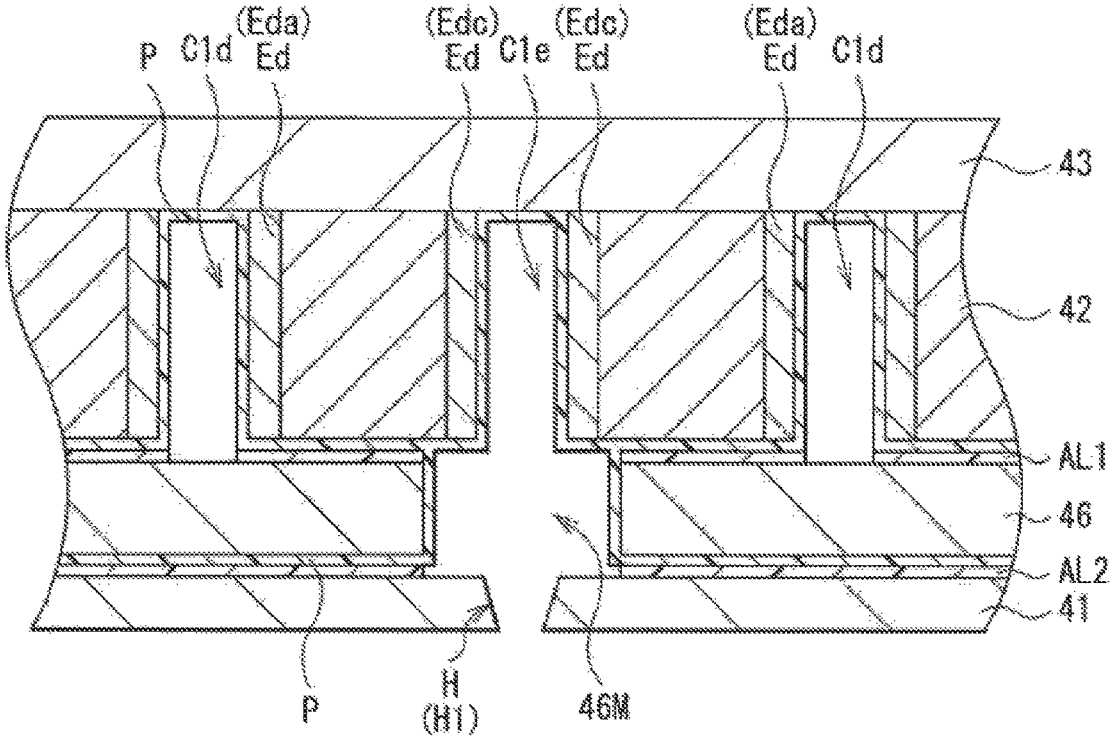
FIG. 14 is a cross-sectional view showing Another Example (1) of the protective film shown in FIG. 13.
Figure 15:
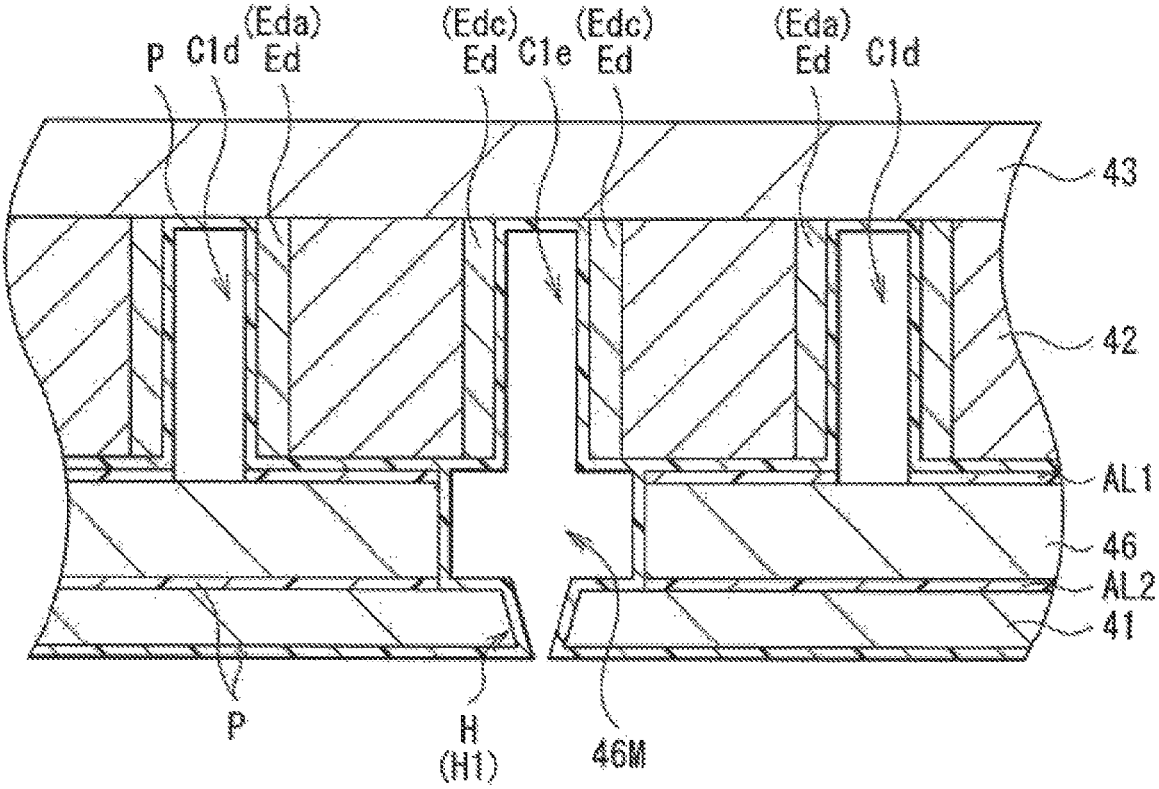
FIG. 15 is a cross-sectional view showing Another Example (2) of the protective film shown in FIG. 13.

FIG. 14 through FIG. 18 show another example of the configuration of the protective film P shown in FIG. 13. It is sufficient for the protective film P to be disposed continuously at least from the inside of the ejection channels C1*e* to the liquid contact surface of the intermediate plate 46 via the end surface of the adhesive layer AL1 exposed on the ejection channel C1*e* side as shown in FIG. 14 and FIG. 15. Thus, since the end surface of the adhesive layer AL1 exposed on the ejection channel C1*e* side is covered with the protective film P, it becomes possible to prevent the decrease in the reliability of the inkjet head 4A caused by the infiltration of the ink 9 to the adhesive layer ALA. The protective film P is not required to be disposed on the surface of the nozzle plate 41 (FIG. 14), and is not required to be disposed on the surface of the intermediate plate 46 (FIG. 15).

Figure 16:
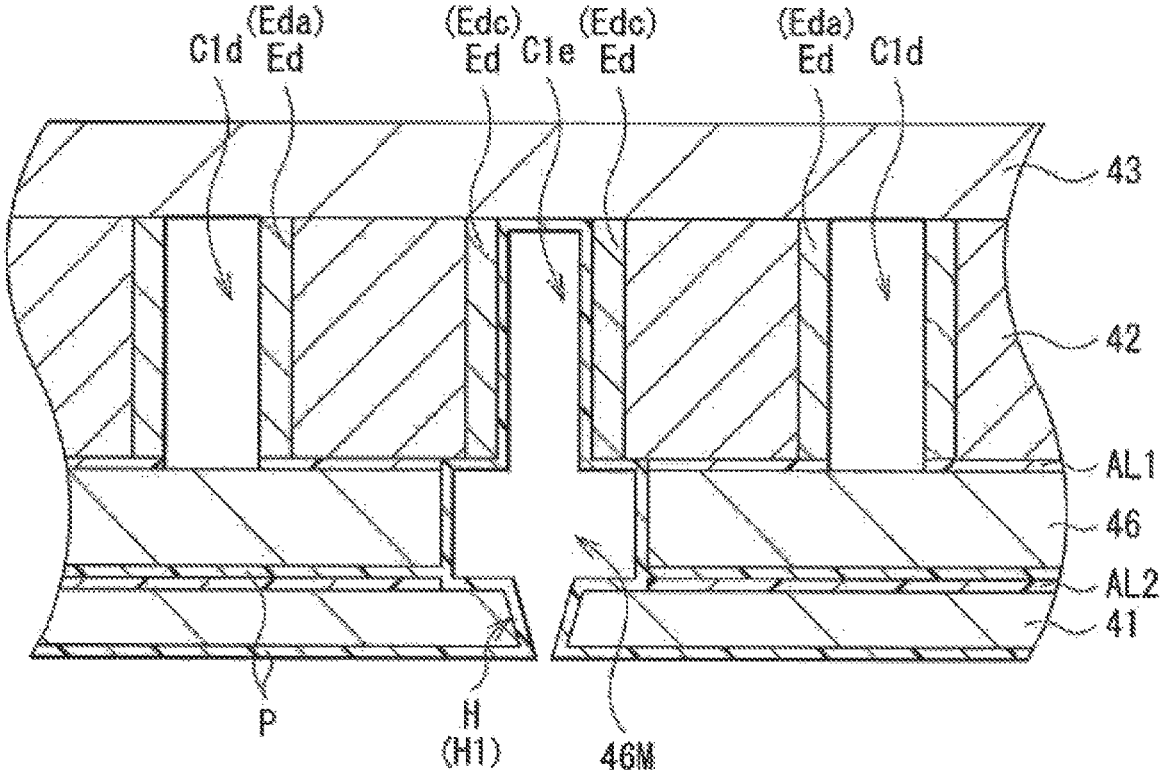
FIG. 16 is a cross-sectional view showing Another Example (3) of the protective film shown in FIG. 13.
Figure 17:
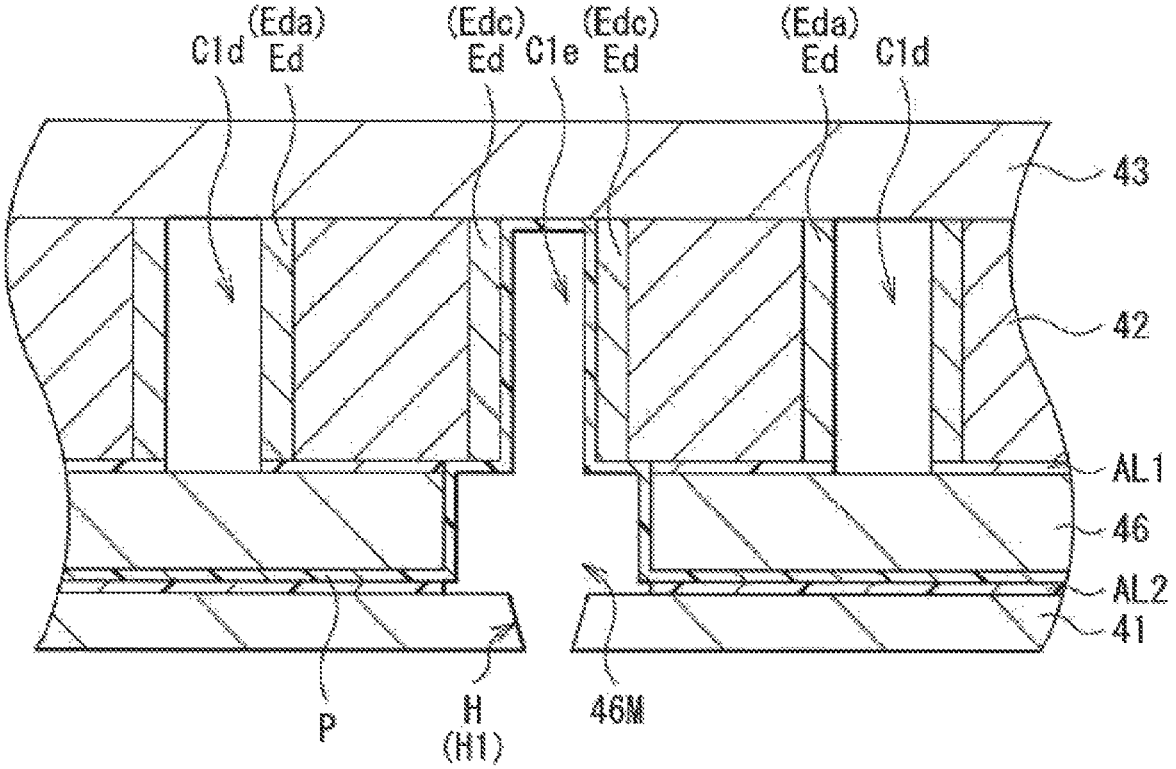
FIG. 17 is a cross-sectional view showing Another Example (4) of the protective film shown in FIG. 13.
Figure 18:
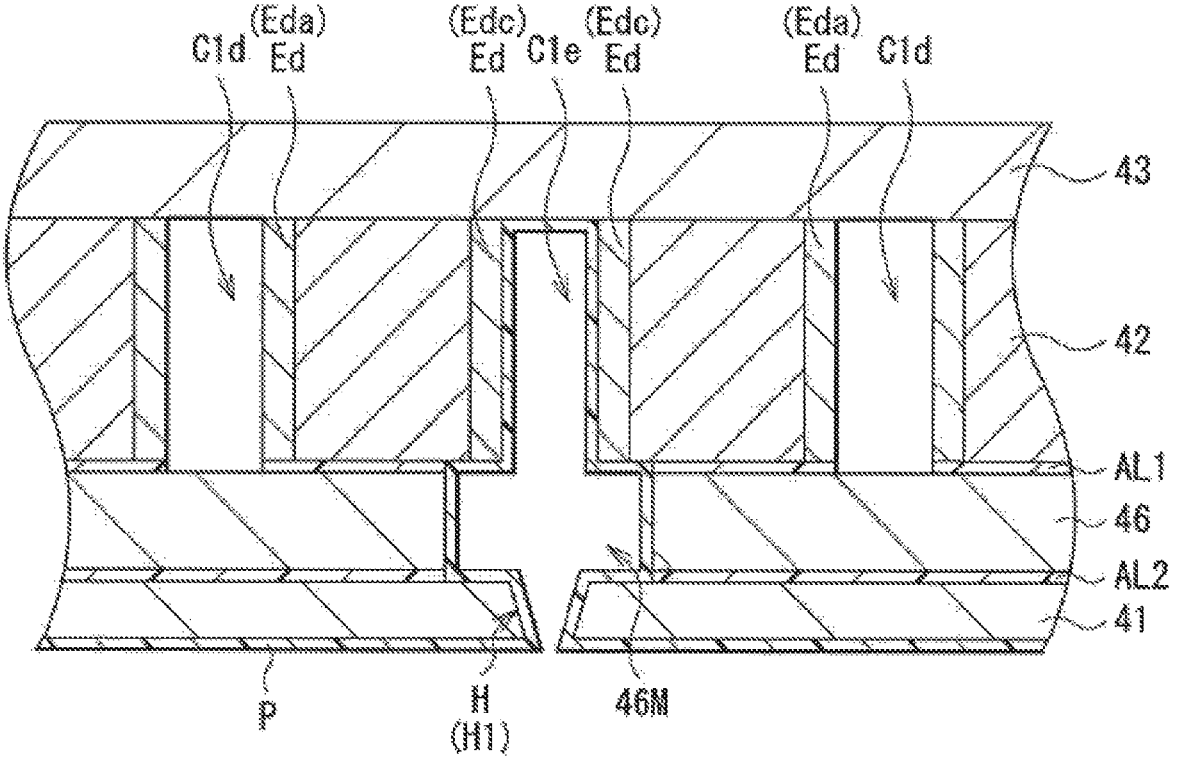
FIG. 18 is a cross-sectional view showing Another Example (5) of the protective film shown in FIG. 13.

Similarly to what is described in the first embodiment, it is preferable for the protective film P to be disposed also inside the dummy channels C1*d*, but it is not required for the protective film P to be disposed on the inner side surfaces and bottom surfaces of the dummy channels C1*d* as shown in FIG. 16, FIG. 17, and FIG. 18. The protective film P is not required to be disposed on one principal surface of the actuator plate 42 (FIG. 16), or not required to be disposed on the one principal surface of the actuator plate 42 and the surface of the nozzle plate 41 (FIG. 17). The protective film P is not required to be disposed on the one principal surface of the actuator plate 42 and the surface of the intermediate plate 46 (FIG. 18).

Figure 19:
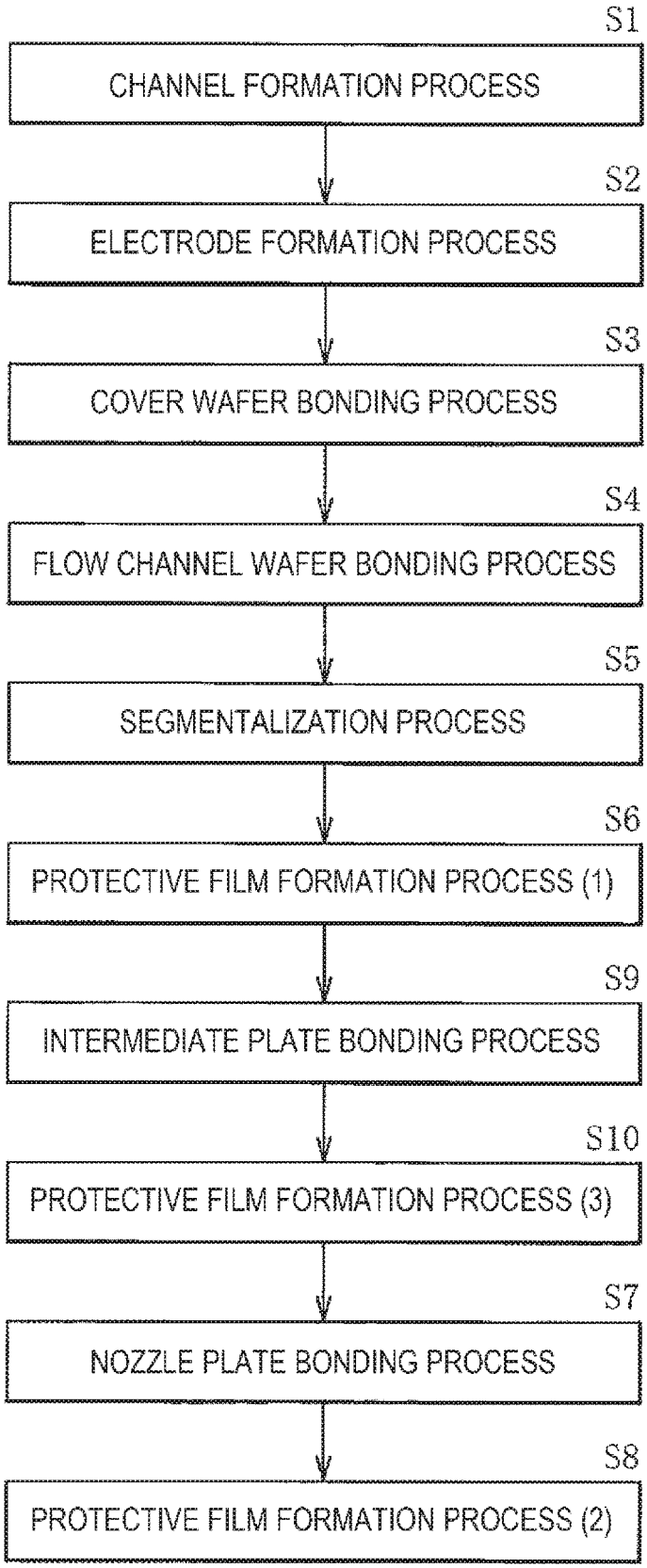

Then, a method of manufacturing the inkjet head 4A will be described using FIG. 19. FIG. 19 is a diagram showing an example of the method of manufacturing the inkjet head 4A in the order of the processes.

Firstly, similarly to what is described in the first embodiment, the channel formation process (step S1), the electrode formation process (step S2), the cover wafer bonding process (step S3), the flow channel wafer bonding process (step S4), and the segmentalizing process (step S5) are performed in this order. Thus, the actuator plate 42, the cover plate 43, and the flow channel plate 44 bonded to each other are formed.

Then, the protective film P is formed (step S6) on one principal surface (a principal surface on an opposite side to the principal surface to which the cover plate 43 has been bonded) of the actuator plate 42 and inside the channels C1, C2. The protective film P is deposited continuously from one principal surface of the actuator plate 42 to the inner side surfaces and the bottom surfaces of the channels C1, C2 via the openings of the channels C1, C2. After forming the protective film P, a surface treatment such as plasma irradiation is performed on the one principal surface of the actuator plate 42. Thus, when bonding (step S9) the intermediate plate 46 to the actuator plate 42, a decrease in adhesive force due to the protective film P can be suppressed.

Subsequently, the intermediate plate 46 is bonded (step S9) to the one principal surface of the actuator plate 42 via the adhesive layer AL1. Subsequently, the protective film P is formed (step S10) continuously from the surface of the intermediate plate 46 to the inside of the ejection channels C1*e*, C2*e* via the communication holes 46M, respectively. Thus, the protective film P is formed continuously from areas adjacent to the communication holes 46M to the inside of the ejection channels C1*e*, C2*e* via the end surface of the adhesive layer AL1 exposed on the ejection channel C1*e*, C2*e* side.

In the present modified example, it becomes possible to form the protective film P covering the end surface of the adhesive layer AL1 exposed on the ejection channel C1*e*, C2*e* side prior to bonding the nozzle plate 41 to the intermediate plate 46 as described above. Therefore, it is possible to form the protective film P in a state in which the end surface of the adhesive layer AL1 exposed on the ejection channel C1*e*, C2*e* side is not hidden behind the nozzle plate 41. Therefore, it becomes easy for the resin material for forming the protective film P to flow on the end surface of the adhesive layer AL1, and it becomes possible to easily cover the end surface of the adhesive layer AL1 with the protective film P having a sufficiently large thickness.

After forming the protective film P from the surface of the intermediate plate 46, the surface treatment such as plasma irradiation is performed on the surface of the intermediate plate 46. Thus, when bonding (step S7) the nozzle plate 41 to the intermediate plate 46, a decrease in adhesive force due to the protective film P can be suppressed.

After performing the surface treatment such as plasma irradiation on the surface of the intermediate plate 46, the nozzle plate 41 is bonded (step S7) to the surface of the intermediate plate 46 via the adhesive layer AL2. Subsequently, the protective film P is formed (step S8) continuously from the surface of the nozzle plate 41 to the inside of the ejection channels C1*e*, C2*e* via the nozzle holes H1, H2 and the communication holes 46M. Thus, the protective film P is formed continuously from the liquid contact surface of the nozzle plate 41 to the inside of the ejection channels C1*e*, C2*e* via the end surface of the adhesive layer AL2 exposed on the communication hole 46 side and the end surface of the adhesive layer AL1 exposed on the communication hole 46 and the ejection channel C1*e*, C2*e* side.

In such a manner, it is possible to manufacture the inkjet head 4A shown in FIG. 13. It is also possible to arrange to omit the formation process (step S8) of the protective film P after bonding the nozzle plate 41 to the intermediate plate 46. By omitting the formation process of the protective film P in the step S8, it is possible to manufacture the inkjet head 4A shown in FIG. 14. Alternatively, it is also possible to arrange to omit the formation process (step S10) of the protective film P after bonding the intermediate plate 46 to the actuator plate 42. Thus, it is possible to manufacture the inkjet head 4A shown in FIG. 15.

Figure 20:
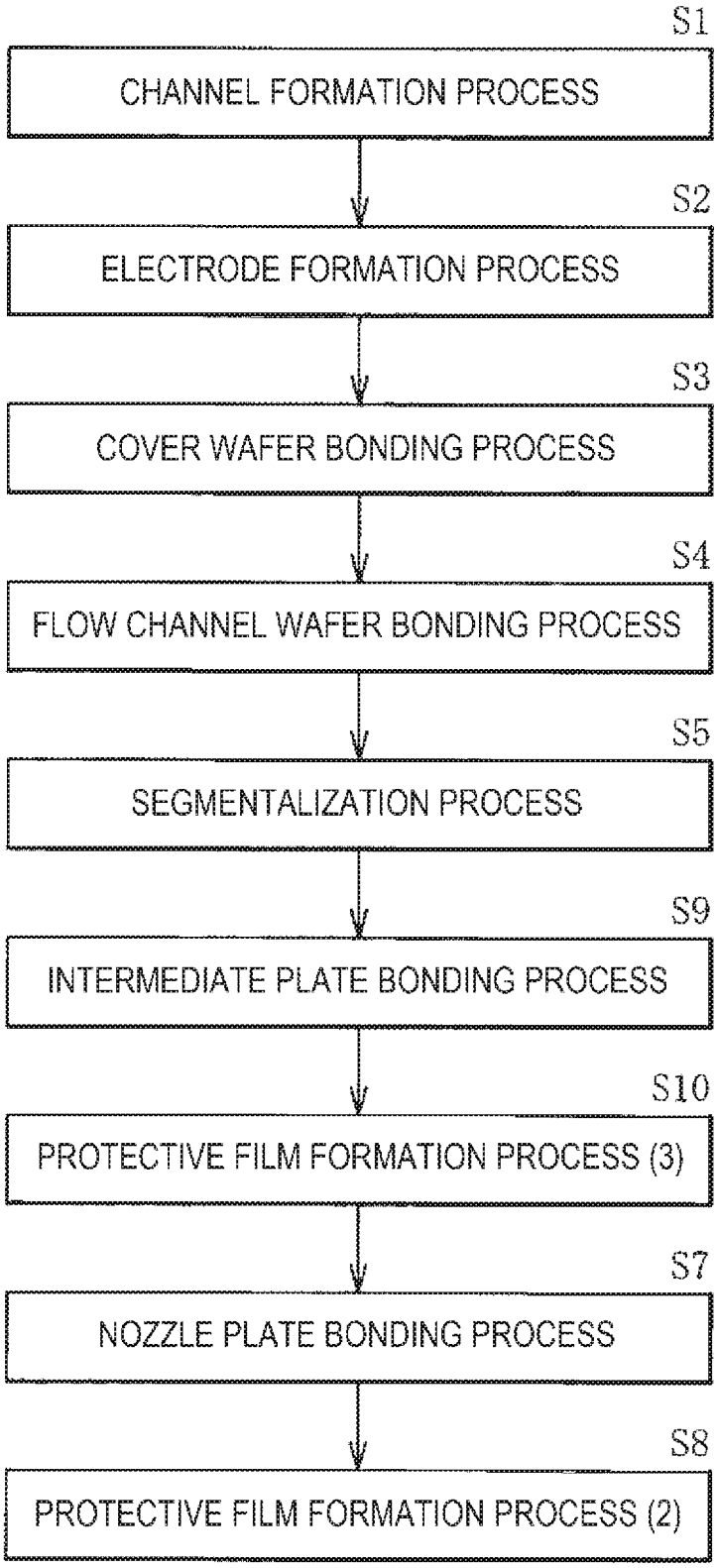
FIG. 20 is a process chart showing another example of the method of manufacturing the liquid jet head shown in FIG. 19.

FIG. 20 is a diagram showing another example of the method of manufacturing the inkjet head 4A. In the present manufacturing process, the protective film P is formed (step S8, step S10) after the process in the step S9 and after the process in the step S7 without performing the formation process (step S6 in FIG. 18) of the protective film P prior to the bonding process (step S9) of the intermediate plate 46. In this manufacturing method, the protective film P is not formed on the inner side surfaces and the bottom surfaces of the dummy channels C1*d*, C2*d*, and it is possible to manufacture the inkjet head 4A shown in FIG. 16. Similarly to what is described with reference to FIG. 19 described above, it is also possible to arrange to omit the formation process (step S8) of the protective film P after bonding the nozzle plate 41 to the intermediate plate 46. By omitting the formation process of the protective film P in the step S8, it is possible to manufacture the inkjet head 4A shown in FIG. 17. Alternatively, similarly to what is described with reference to FIG. 19 described above, it is also possible to arrange to omit the formation process (step S10) of the protective film P after bonding the intermediate plate 46 to the actuator plate 42. By omitting the formation process of the protective film P in the step S10, it is possible to manufacture the inkjet head 4A shown in FIG. 18.

In the inkjet head 4A, since the nozzle plate 41 and the actuator plate 42 are bonded to each other via the intermediate plate 46, the openings of the ejection channels C1*e*, C2*e* disposed on one principal surface of the actuator plate 42 are communicated with the nozzle holes H1. H2 via the communication holes 46M of the intermediate plate 46. Therefore, the volume of the communication part from the opening of the ejection channel C1*e*, C2*e* to the nozzle hole H1, H2 becomes larger compared to the inkjet head 4 according to the first embodiment described above. Thus, it becomes easier for the resin material forming the protective film P to flow. Therefore, as shown in FIG. 16 and FIG. 18, it becomes possible to form the protective film P having a sufficiently large thickness, even when forming the protective film P covering the end surface of the adhesive layer AL1 exposed on the ejection channel C1*e*, C2*e* side after bonding the nozzle plate 41 to the intermediate plate 46.

3. Second Embodiment

Figure 21:
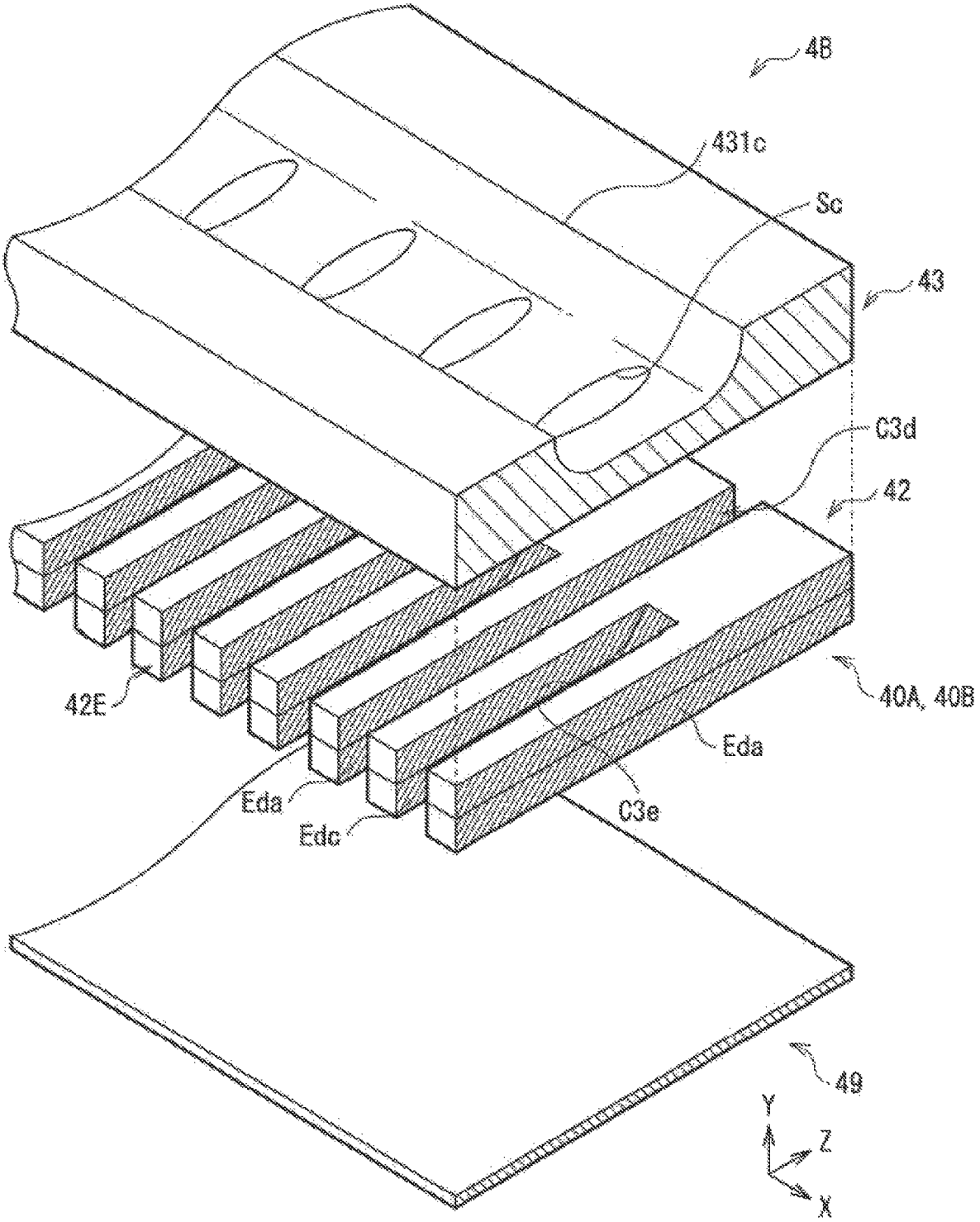
FIG. 21 is an exploded perspective view showing a configuration of a substantial part of a liquid jet head according to a second embodiment of the present disclosure.
Figure 22:
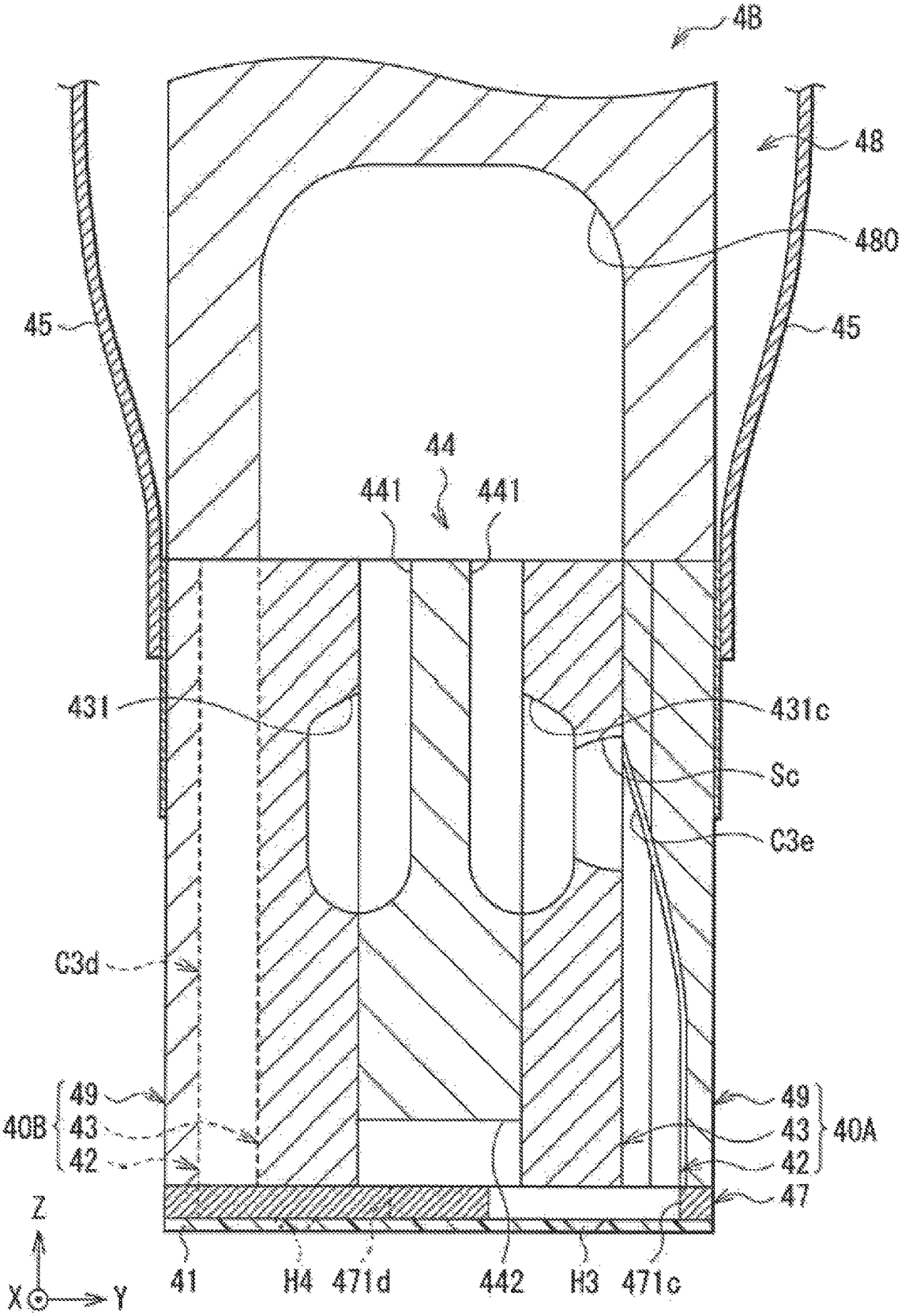
FIG. 22 is a cross-sectional view of the liquid jet head shown in FIG. 21.
Figure 23:
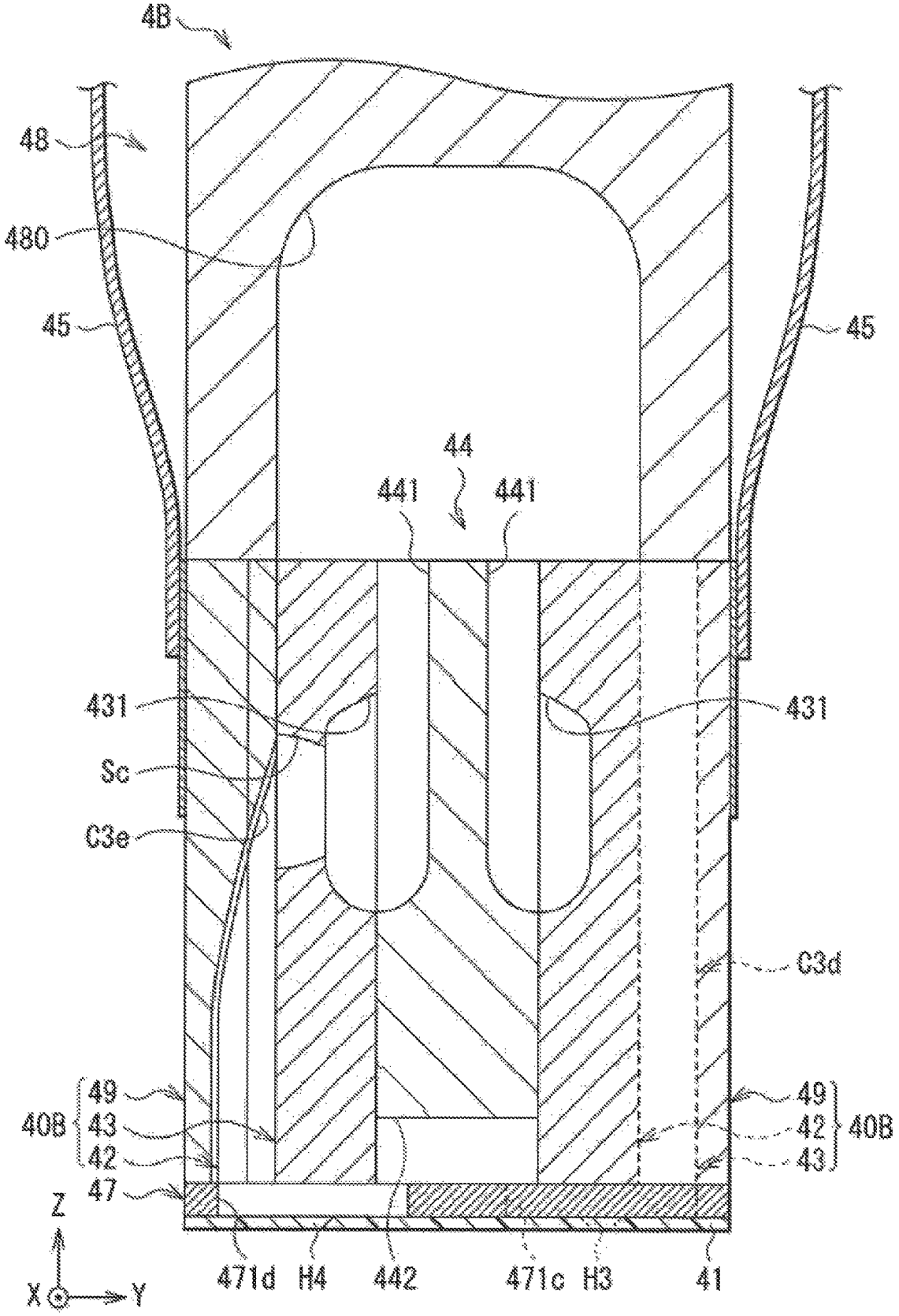
FIG. 23 is another cross-sectional view of the liquid jet head shown in FIG. 22.

FIG. 21, FIG. 22, and FIG. 23 are diagrams schematically showing a configuration of an inkjet head 4B according to a second embodiment of the present disclosure. FIG. 21 is a perspective view showing a configuration example of a substantial part of the inkjet head 4B. FIG. 22 is a cross-sectional view showing a configuration example of the Y-Z cross-sectional surface including an ejection channel C3*e* of a head chip 40A and a dummy channel C3*d* of a head chip 40B in the inkjet head 4B. FIG. 23 is a cross-sectional view showing a configuration example of the Y-Z cross-sectional surface including a dummy channel C3*d* of the head chip 40A and an ejection channel C3*e* of the head chip 40B in the inkjet head 4B. The inkjet head 4B is of a circulation type (an edge-shoot circulation type) for circulating the ink between the inkjet head 4B and the ink tank 3 out of so-called edge-shoot types for ejecting the ink from a tip part in the extending direction (the Z-axis direction) of the ejection channel C3*e*. Although the illustration of a return plate 47 (described later) and the nozzle plate 41 is omitted in FIG. 21, the return plate 47 (described later) and the nozzle plate 41 are bonded to a lower end surface 42E of the actuator plate 42. The configuration of the present disclosure can also be applied to such an edge-shoot type inkjet head 4B.

As shown in FIG. 21 through FIG. 23, the inkjet head 4B is provided with the pair of head chips 40A, 40B, the return plate 47, the nozzle plate 41, the flow channel plate 44, an entrance manifold 48, an exit manifold (not shown), and the flexible printed circuit board 45.

The pair of head chips 40A, 40B have substantially the same configurations, and are disposed at substantially symmetrical positions so as to have substantially symmetrical postures across the flow channel plate 44 in the Y-axis direction. The head chips 40A, 40B are each provided with the cover plate 43, the actuator plate 42, and a protective plate 49 in this order from a position near to the flow channel plate 44. The return plate 47 and the nozzle plate 41 are disposed in common to the head chips 40A, 40B. It should be noted that, here, in addition to the head chips 40A, 40B, the configuration including the return plate 47 and the nozzle plate 41 corresponds to a specific example of a "head chip" in the present disclosure.

The actuator plate 42 has the X-axis direction as the longitudinal direction, and the Z-axis direction as the short-side direction, and expands along the X-Z plane. The one principal surface of the actuator plate 42 is bonded to the protective plate 49, and the other principal surface is bonded to the cover plate 43. The lower end surface 42E of the actuator plate 42 is disposed on the X-Z plane.

The actuator plate 42 is provided with the plurality of ejection channels C3*e* and the plurality of dummy channels C3*d*. The plurality of ejection channels C3*e* and the plurality of dummy channels C3*d* are each disposed so as to linearly extend in the Z-axis direction. The ejection channels C3*e* and the dummy channels C3*d* are alternately disposed so as to be separated from each other in the X-axis direction. The lower end part of the ejection channel C3*e* extends up to the lower end surface 42E of the actuator plate 42 as shown in FIG. 21 to form an opening in the lower end surface 42E. This opening forms an ejection end for ejecting the ink 9. An upper end part of the ejection channels C3*e* terminates within the actuator plate 42 without reaching an upper end surface (a surface opposite to the lower end surface 42E) of the actuator plate 42. The upper end part of the dummy channel C3*d* opens in the upper end surface, and the lower end part of the dummy channel C3*d* opens in the lower end surface 42E. Similarly to what is described in the first embodiment described above, on the inner side surface of the ejection channel C3*e*, there is disposed the common electrode Edc, and in the inner side surface of the dummy channel C3*d*, there is disposed the active electrode Eda.

The ejection channels C3*e* and the dummy channels C3*d* of the head chip 40B are arranged so as to be shifted as much as a half pitch in the X-axis direction with respect to the arrangement pitch of the ejection channels C3*e* and the dummy channels C3*d* of the head chip 40A. In other words, the ejection channels C3*e* and the dummy channels C3*d* of the head chip 40A, and the ejection channels C3*e* and the dummy channels C3*d* of the head chip 40B are arranged in a zigzag manner.

Therefore, as shown in FIG. 22, the ejection channels C3*e* of the head chip 40A and the dummy channels C3*d* of the head chip 40B are opposed to each other in the Y-axis direction. Similarly, as shown in FIG. 23, the dummy channels C3*d* of the head chip 40A and the ejection channels C3*e* of the head chip 40B are opposed to each other in the Y-axis direction. It should be noted that the pitch of the ejection channels C3*e* and the dummy channels C3*d* in each of the head chips 40A, 40B can arbitrarily be changed.

The cover plate 43 has the X-axis direction as the longitudinal direction, and the Z-axis direction as the short-side direction, and expands along the X-Z plane. The cover plate 43 is provided with a common ink chamber 431*c* opening on the flow channel plate 44 side, and a plurality of slits Sc each communicated with the common ink chamber 431*c* and opening on the actuator plate 43 side. The plurality of slits Sc is disposed at positions corresponding to the plurality of ejection channels C3*e*. The common ink chamber 431*c* is disposed commonly to the plurality of slits Sc, and is communicated with the ejection channels C3*e* through the plurality of slits Se. The common ink chamber 431*c* is not communicated with the dummy channels C3*d*.

The common ink chamber 431*c* is a recess extending in the X-axis direction. It is arranged that the ink 9 inflows into the common ink chamber 431*c* through the flow channel plate 44. The plurality of slits Sc is arranged at positions each overlapping a part of the common ink chamber 431*c* in the Y-axis direction. The plurality of slits Sc is communicated with the common ink chamber 431*c* and the plurality of ejection channels C3*e*. It is desirable for the width in the X-axis direction of each of the slits Sc to substantially be the same as the width in the X-axis direction of each of the ejection channels C3*e*.

The protective plate 49 has the X-axis direction as the longitudinal direction, and the Z-axis direction as the short-side direction, and expands along the X-Z plane similarly to the cover plate 43. The protective plate 49 has roughly the same planar shape as the planar shape on the X-Z plane of the actuator plate 42. The openings of the plurality of ejection channels C1*e* and the plurality of dummy channels C3*d* disposed on one principal surface of the actuator plate 42 are arranged to be closed by the protective plate 49.

The flow channel plate 44 is sandwiched between the head chip 40A and the head chip 40B in the Y-axis direction. It is preferable for the flow channel plate 44 to integrally be formed of the same member. The flow channel plate 44 has the X-axis direction as the longitudinal direction, and the Z-axis direction as the short-side direction, and expands along the X-Z plane. When viewed from the Y-axis direction, the outer shape of the flow channel plate 44 is substantially the same as the outer shape of the cover plate 43.

On one principal surface of the flow channel plate 44, there is disposed the head chip 40A, and on the other principal surface, there is disposed the head chip 40B. As shown in FIG. 22 and FIG. 23, to the one principal surface and the other principal surface of the flow channel plate 44, there are respectively provided entrance flow channels 441 individually communicated with the common ink chamber 431*c*, and exit flow channels 442 individually communicated with circulation channels 471*c*, 471*d* of the return plate 47.

The entrance flow channels 441 are recessed toward the inside in the Y-axis direction from each of the one principal surface and the other principal surface of the flow channel plate 44. The lower end part of each of the entrance flow channels 441 is communicated with the common ink chamber 431*c*, and the upper end part of each of the entrance flow channels 441 opens in the upper end surface of the flow channel plate 44. Each of the exit flow channels 442 is disposed in the lower end part of the flow channel plate 44, and is recessed upward from the lower end surface of the flow channel plate 44. The exit flow channel 442 penetrates the flow channel plate 44 in the Y-axis direction. The exit flow channel 442 is connected to the exit manifold on the outer side in the X-axis direction of the entrance flow channel 441.

The entrance manifold 48 is bonded to the head chips 40A, 40B and the upper end surface of the flow channel plate 44. The entrance manifold 48 is provided with a supply channel 480 communicated with each of the entrance flow channels 441. The supply channel 480 is recessed upward from the lower end surface of the entrance manifold 48.

The return plate 47 has the X-axis direction as the longitudinal direction, and the Y-axis direction as the short-side direction, and expands along the X-Z plane. The return plate 47 is bonded to the lower end surfaces of the head chips 40A, 40B and the lower end surface of the flow channel plate 44 via the adhesive layer (the adhesive layer AL1 in FIG. 24 described later). In other words, the return plate 47 is disposed on the ejection end side in the head chip 40A and the head chip 40B in common thereto. The return plate 47 is a spacer plate intervening between the ejection end in the head chip 40A and the head chip 40B, and an upper surface of the nozzle plate 41. In the second embodiment, the return plate 47 corresponds to a specific example of a "bonded plate" in the present disclosure.

The return plate 47 is provided with a plurality of circulation channels 471*c*, 471*d* for coupling the ejection channels C3*e* of the head chips 40A, 40B and the exit flow channels 442 to each other. The plurality of circulation channels 471*c*, 471*d* penetrates the return plate 47 in the Z-axis direction. The circulation channel 471*c* is disposed at a position corresponding to the ejection channel C3*e* of the head chip 40A, and the circulation channel 471*d* is disposed at a position corresponding to the ejection channel C3*e* of the head chip 40B. The inside end part in the Y-axis direction of the circulation channel 471*c* is communicated with the exit flow channel 442, and the outside end part in the Y-axis direction of the circulation channel 471*c* is communicated with the ejection channel C3*e* of the head chip 40A (FIG. 22). The inside end part in the Y-axis direction of the circulation channel 471*d* is communicated with the exit flow channel 442, and the outside end part in the Y-axis direction of the circulation channel 471*d* is communicated with the ejection channel C3*e* of the head chip 40B (FIG. 23). Here, the circulation channels 471*c*, 471*d* correspond to a specific example of a "communication hole" in the present disclosure.

The nozzle plate 41 has the X-axis direction as the longitudinal direction, and the Y-axis direction as the short-side direction, and expands along the X-Z plane. The nozzle plate 41 is bonded to one principal surface of the return plate 47 via the adhesive layer (the adhesive layer AL2 in FIG. 24 described later) In the nozzle plate 41, there is arranged a plurality of nozzle holes H3, H4 penetrating the nozzle plate 44 in the Z-axis direction.

As shown in FIG. 22, in the nozzle plate 41, the nozzle holes H3 are each formed in a part opposed in the Z-axis direction to each of the circulation channels 471*c* of the return plate 47. In other words, the nozzle holes H3 are arranged on a straight line at intervals in the X-axis direction at the same pitch as that of the circulation channels 471*c*. The nozzle holes H3 are communicated with, for example, the circulation channels 471*c* in a central part in the Y-axis direction. Thus, the nozzle holes H3 are communicated with the corresponding ejection channels C3*e* of the head chip 40A via the circulation channels 471*c*, respectively.

As shown in FIG. 23, in the nozzle plate 41, the nozzle holes H4 are each formed in a part opposed in the Z-axis direction to each of the circulation channels 471*d* of the return plate 47. In other words, the nozzle holes H4 are arranged on a straight line at intervals in the X-axis direction at the same pitch as that of the circulation channels 471*d*. The nozzle holes H4 are each communicated with, for example, the circulation channel 471*d* in a central part in the Y-axis direction in the circulation channel 471*d*. Thus, the nozzle holes 114 are communicated with the corresponding ejection channels C3*e* of the head chip 40B via the circulation channels 471*d*, respectively. The dummy channels C3*d* are not communicated with the nozzle holes H3, H4, and are covered with the return plate 47 from below.

In other words, the ink 9 having been supplied to each of the ejection channels C3*e* has contact with an area adjacent to the circulation channel 471*c*, 471*d* of the return plate 47, and is then jetted. In other words, the return plate 47 has a surface (hereinafter referred to as a liquid contact surface of the return plate 47) which the ink 9 having flowed into the ejection channel C3*e* has contact with. For example, the ink 9 has contact with an inner surface of each of the circulation channels 471*c*, 471*d*. In the second embodiment, the surfaces which the ink 9 having flowed into the ejection channels C3*e* has contact with out of the return plate 47 correspond to a specific example of a "liquid contact surface" in the present disclosure.

Figure 24:
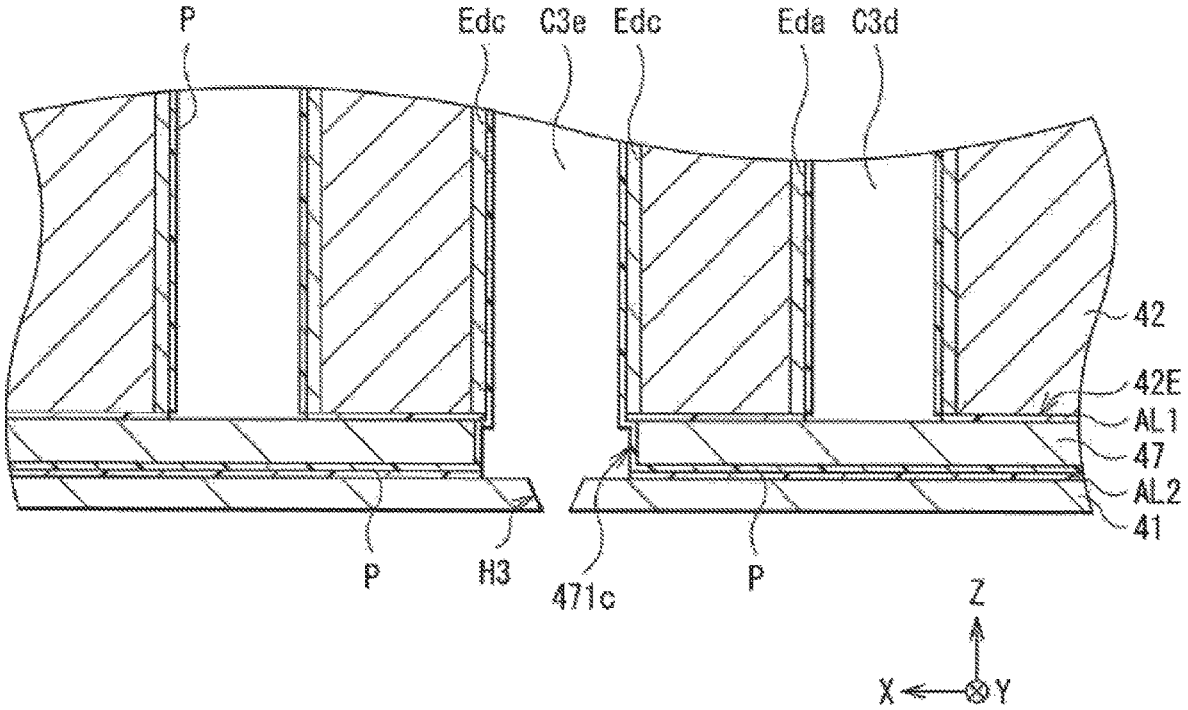
FIG. 24 is a cross-sectional view showing, in an enlarged manner, of the liquid jet head shown in FIG. 23.

FIG. 24 shows an example of a configuration in the X-Z cross-sectional surface of the head chip 40A, the return plate 47, and the nozzle plate 41 at a position where the actuator plate 42 is included. The lower end surface 42E of the actuator plate 42 (the head chip 40A) is bonded to the return plate 47 with the adhesive layer AL1, and one principal surface of the return plate 47 is bonded to the nozzle plate 41 with the adhesive layer AL2. Although the illustration of the head chip 40B side will be omitted, the head chip 40B side has substantially the same configuration as that of the head chip 40A. Here, the adhesive layer AL1 corresponds to a specific example of an "adhesive layer" in the present disclosure.

The protective film P covers, for example, the inner side surfaces and the bottom surfaces of the ejection channels C3*e* across the common electrodes Edc, respectively. The protective film P is disposed continuously from the inside of the ejection channels C3*e* to the liquid contact surface of the return plate 47 via the end surface of the adhesive layer AL1 exposed on the ejection channel C3*e* side. The protective film P can also be disposed on one principal surface of the return plate 47. Alternatively, although not shown in the drawings, the protective film P can also be disposed continuously from the inside of the ejection channels C3*e* to the liquid contact surface of the nozzle plate 41 via the end surface of the adhesive layer ALA exposed on the ejection channel C3*e* side, the liquid contact surface of the return plate 47, and the end surface of the adhesive layer AL2 exposed on the circulation channel 471*c* side. The inner side surface and the bottom surface of the dummy channel C3*d* are not required to be covered with the protective film P.

Also in the inkjet head 4B according to the present embodiment, similarly to what is described in the first embodiment described above, since the end surface of the adhesive layer AL1 exposed on the ejection channel C3*e* side is covered with the protective film P, the ink 9 in the ejection channel C3*e* becomes difficult to infiltrate in the adhesive layer ALL Thus, it becomes possible to suppress the degradation of the reliability of the inkjet head 4B caused by the infiltration of the ink 9 in the adhesive layer AL1.

Further, in the edge-shoot type inkjet head 4B, the ejection end of the ejection channel C3*e* becomes smaller compared to the side-shoot type inkjet head 4, but in the inkjet head 4B, it becomes possible to form the protective film P having a sufficiently large thickness for the following reason.

In the inkjet head 4B, the opening of the ejection channel C3*e* disposed on the lower end surface 42E of the actuator plate 42 is communicated with the nozzle hole H3 (or the nozzle hole H4) via the circulation channel 471*c* (or the circulation channel 471*d*) of the return plate 47. Therefore, the volume of the communication part from the opening of the ejection channel C3*e* to the nozzle hole 113 becomes larger compared to the case of directly bonding the nozzle plate 41 to the lower end surface 42E of the actuator plate 42. Thus, it becomes easier for the resin material forming the protective film P to flow. Further, the inkjet head 4B is a circulation type inkjet head having the circulation channels 471*c*, 471*d*, and the flow channels in the inkjet head 4B are made easier for the fluid to move compared to the non-circulation type inkjet head. Thus, it becomes easier for the resin material forming the protective film P to flow. Therefore, it is possible to cover the end surface of the adhesive layer AL1 exposed on the ejection channel C3*e* side with the protective film P having the sufficiently large thickness.

Further, in the inkjet head 4B, similarly to what is described in the above modified example, it becomes possible to form the protective film P covering the end surface of the adhesive layer AL1 exposed on the ejection channel C3*e* side prior to bonding the nozzle plate 41 to the return plate 47. Therefore, it is possible to form the protective film P in a state in which the end surface of the adhesive layer AL1 exposed on the ejection channel C3*e* side is not hidden behind the nozzle plate 41. Therefore, it becomes easy for the resin material for forming the protective film P to flow on the end surface of the adhesive layer AL1, and it becomes possible to easily cover the end surface of the adhesive layer AL1 with the protective film P.

4. Other Modified Examples

The present disclosure is described hereinabove citing the embodiments, but the present disclosure is not limited to the embodiments, and a variety of modifications can be adopted.

For example, in the embodiment and so on described above, the description is presented specifically citing the configuration examples (the shapes, the arrangements, the number and so on) of each of the members in the printer 1 and the inkjet heads 4, 4A, and 4B, but what is described in the above embodiments is not a limitation, and it is possible to adopt other shapes, arrangements, numbers and so on. Further, the values or the ranges, the magnitude relation and so on of a variety of parameters described in the above embodiments are not limited to those described in the above embodiments, but can also be other values or ranges, other magnitude relations and so on.

Specifically, for example, in the first embodiment described above, the description is presented citing the inkjet head 4 of the two column type (having the two nozzle columns 411, 412), but the example is not a limitation. Specifically, for example, it is also possible to adopt an inkjet head of a single-column type (having a single nozzle column), or an inkjet head of a multi-column type (having three or more nozzle columns j with three or more columns.

Further, for example, in the first embodiment described above, there is described the case in which the nozzle columns 411, 412 each extend linearly along the X-axis direction, but this example is not a limitation. It is also possible to arrange that, for example, the nozzle columns 411, 412 each extend in an oblique direction. Further, the shape of each of the nozzle holes H1, H2, H3, and H4 is not limited to the circular shape as described in the above embodiments, but can also be, for example, a polygonal shape such as a triangular shape, an elliptical shape, or a star shape.

Further, for example, although the case in which the circulation type is adopted in the inkjet heads 4, 4A, and 4B is described in the above embodiment, this example is not a limitation, and it is also possible to, for example, adopt other types without the circulation in the inkjet heads 4, 4A, and 4B.

Further, it is also possible for the actuator plate 42 to be a so-called cantilever type (a monopole type) actuator formed of a single piezoelectric substrate having the polarization direction set to one direction along the thickness direction.

Further, in the above embodiment and so on, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange to apply the "liquid jet head" (the inkjet head 4) and the "head chip" (the head chip 4*c*) in the present disclosure to other devices than the inkjet printer. Specifically, for example, it is also possible to arrange to apply the "liquid jet head" or the "head chip" in the present disclosure to a device such as a facsimile or an on-demand printer.

Further, although the recording object of the printer 1 is the recording paper P in the embodiments and the modified example described above, the recording object of the "liquid jet recording device" in the present disclosure is not limited to the recording paper P. It is possible to form characters and patterns by jetting the ink to a variety of materials such as cardboard, cloth, plastic or metal. Further, the recording object is not required to have a flat shape, and it is also possible to perform painting or decoration of a variety of 3D objects such as food, architectural materials such as a tile, furniture, or a vehicle. Further, it is possible to print fabric with the "liquid jet recording device" in the present disclosure, or it is also possible to perform 3D shaping by solidifying the ink after jetted (a so-called a 3D printer).

Further, it is also possible to apply the variety of examples described hereinabove in arbitrary combination.

It should be noted that the advantages described in the specification are illustrative only but are not a limitation, and other advantages can also be provided.

Further, the present disclosure can also take the following configurations:

<1> A head chip comprising an actuator plate having a plurality of ejection channels respectively communicated with nozzle holes and electrodes disposed on inner walls of the respective ejection channels; a bonded plate to be bonded to the actuator plate, and having a liquid contact surface which liquid entered the ejection channels has contact with an adhesive layer disposed between the bonded plate and the actuator plate, and adapted to bond the bonded plate and the actuator plate to each other; and a protective film adapted to cover continuously from inner walls of the respective ejection channels to at least a part of the liquid contact surface via an end surface of the adhesive layer exposed on the ejection channel side.

<2> The head chip according to <1>, wherein the electrodes disposed on the inner walls of the ejection channels are each a common electrode, the actuator plate further has non-ejection channels each disposed between the ejection channels adjacent to each other and individual electrodes respectively disposed on inner walls of the non-ejection channels, and the protective film also covers the inner walls of the non-ejection channels.

<3> The head chip according to <1> or <2>, wherein the bonded plate is a nozzle plate having the nozzle holes.

<4> The head chip according to <1> or <2>, further comprising a nozzle plate having the nozzle holes, wherein the bonded plate is disposed between the nozzle plate and the actuator plate.

<5> The head chip according to <4>, wherein the bonded plate has communication holes adapted to respectively communicate the ejection channels and the nozzle holes with each other, and the actuator plate further has non-ejection channels each disposed between the ejection channels adjacent to each other, and closed by the bonded plate.

<6> The head chip according to <4> or <5>, wherein the bonded plate has an insulating property.

<7> The head chip according to any one of <1> to <6>, wherein the ejection channels are each communicated with the nozzle hole in a central part in an extending direction of the ejection channel.

<8> The head chip according to <7>, further comprising a liquid introduction flow channel communicated with the ejection channels; and a liquid discharge flow channel communicated with the ejection channels, and separately disposed from the liquid introduction flow channel.

<9> The head chip according to any one of <1> to <8>, wherein the protective film covers the electrodes.

<10> The head chip according to any one of <1> to <9>, wherein the protective film includes a para-xylylene resin material.

<11> A liquid jet head comprising the head chip according to any one of <1> to <10>; and a supply mechanism adapted to supply the liquid to the head chip.

<12> A liquid jet recording device comprising the liquid jet head according to <11>; and a containing section adapted to contain the liquid.

What is claimed is:

1. A head chip comprising:

an actuator plate having a plurality of ejection channels respectively communicated with nozzle holes and electrodes disposed on inner walls of the respective ejection channels;

a bonded plate to be bonded to the actuator plate, and having a liquid contact surface which liquid entered the ejection channels has contact with;

an adhesive layer disposed between the bonded plate and the actuator plate, and adapted to bond the bonded plate and the actuator plate to each other; and a protective film adapted to cover continuously from inner walls of the respective ejection channels to at least a part of the liquid contact surface via an end surface of the adhesive layer exposed on the ejection channel side, wherein the electrodes disposed on the inner walls of the ejection channels are each a common electrode, the actuator plate further has non-ejection channels each disposed between the ejection channels adjacent to each other and individual electrodes respectively disposed on inner walls of the non-ejection channels, and the protective film also covers the inner walls of the non-ejection channels.

2. The head chip according to claim 1, wherein the bonded plate is a nozzle plate having the nozzle holes.

3. The head chip according to claim 1, further comprising a nozzle plate having the nozzle holes, wherein the bonded plate is disposed between the nozzle plate and the actuator plate.

4. The head chip according to claim 3, wherein the bonded plate has communication holes adapted to respectively communicate the ejection channels and the nozzle holes with each other, and the non-ejection channels closed by the bonded plate.

5. The head chip according to claim 3, wherein the bonded plate has an insulating property.

6. The head chip according to claim 1, wherein the ejection channels are each communicated with the nozzle hole in a central part in an extending direction of the ejection channel.

7. The head chip according to claim 6, further comprising:

a liquid introduction flow channel communicated with the ejection channels; and a liquid discharge flow channel communicated with the ejection channels, and separately disposed from the liquid introduction flow channel.

8. The head chip according to claim 1, wherein the protective film covers the electrodes.

9. The head chip according to claim 1, wherein the protective film includes a para-xylylene resin material.

10. A liquid jet head comprising:

the head chip according to claim 1; and a supply mechanism adapted to supply the liquid to the head chip.

11. A liquid jet recording device comprising:

the liquid jet head according to claim 10; and a containing section adapted to contain the liquid.

* * * * *